US011511913B2

(12) United States Patent
Tan

(10) Patent No.: US 11,511,913 B2
(45) Date of Patent: Nov. 29, 2022

(54) HANGING BAG DISPENSER

(71) Applicant: Stephanie Tan, Harahan, LA (US)

(72) Inventor: Stephanie Tan, Harahan, LA (US)

( * ) Notice: Subject to any disclaimer, the term of this patent is extended or adjusted under 35 U.S.C. 154(b) by 288 days.

(21) Appl. No.: 17/010,263

(22) Filed: Sep. 2, 2020

(65) Prior Publication Data

US 2022/0063871 A1 Mar. 3, 2022

(51) Int. Cl.

| | |
|---|---|
| ***A47F 9/04*** | (2006.01) |
| ***B65D 33/14*** | (2006.01) |
| ***B65D 33/00*** | (2006.01) |

(52) U.S. Cl.

CPC ..... *B65D 33/14* (2013.01); *B65D 33/001* (2013.01); *A47F 9/042* (2013.01)

(58) Field of Classification Search

CPC ..... B65D 33/14; B65D 33/001; A47F 9/042
See application file for complete search history.

(56) References Cited

U.S. PATENT DOCUMENTS

| | | | | |
|---|---|---|---|---|
| 4,858,862 A | | 8/1989 | Prader | |
| 5,092,548 A | | 3/1992 | Bayes | |
| 5,209,371 A | | 5/1993 | Daniels | |
| 5,584,402 A | | 12/1996 | Johnson | |
| 5,924,573 A | * | 7/1999 | Piraneo | B65D 33/001 383/207 |
| 5,996,801 A | * | 12/1999 | Tsu | B65D 33/001 206/554 |
| 6,264,035 B1 | * | 7/2001 | Petrie | B65D 33/001 206/554 |
| 6,264,059 B1 | | 7/2001 | Requena | |
| 6,382,429 B1 | * | 5/2002 | Yeh | B65D 33/001 211/183 |
| 6,585,197 B1 | | 7/2003 | Daniels | |
| 6,729,483 B1 | * | 5/2004 | Nguyen | A47F 9/042 211/163 |
| 7,287,654 B2 | | 10/2007 | Nguyen | |
| 2005/0087542 A1 | * | 4/2005 | Bazbaz | B65D 33/001 221/33 |
| 2005/0178736 A1 | * | 8/2005 | Wilfong | B65D 83/08 211/59.1 |

(Continued)

FOREIGN PATENT DOCUMENTS

| | | |
|---|---|---|
| GB | 2309216 B | 12/1997 |
| WO | WO2016134003 A1 | 8/2016 |

*Primary Examiner* — Tuyen K Vo
(74) *Attorney, Agent, or Firm* — David A. Belasco; Belasco Jacobs & Townsley, PC

(57) ABSTRACT

A hanging bag dispenser includes a bag support platform having a surface that contacts a last bag in a vertically supported bag pack. A mounting device is attached to the platform to engage a mounting aperture that penetrates each bag in the bag pack. A positioning system is attached to the bag support platform and maintains the bag support platform at a sufficient height to allow the bag pack to extend downwardly from the mounting device. A pivotally mounted bag control arm is mounted to the platform and permits installation of the bag pack on the mounting device when pivoted to a loading position and rests upon an outermost bag in the bag pack when pivoted to a control position. A guard plate is mounted adjacent the control arm that prevents access to an upper portion of the bag pack when the control arm is in to the control position.

47 Claims, 29 Drawing Sheets

(56) References Cited

U.S. PATENT DOCUMENTS

| | | | | |
|---|---|---|---|---|
| 2005/0269349 | A1* | 12/2005 | Daniels | B65D 33/14 221/282 |
| 2006/0038007 | A1* | 2/2006 | Dickover | A47F 9/046 235/383 |
| 2007/0176058 | A1* | 8/2007 | Kohn | B65D 75/008 211/12 |
| 2008/0053929 | A1* | 3/2008 | Nguyen | B65H 35/10 221/92 |
| 2008/0128465 | A1* | 6/2008 | Wilfong | A47F 9/042 225/106 |
| 2009/0274396 | A1* | 11/2009 | Wilkerson | B65D 33/001 383/9 |
| 2009/0289019 | A1* | 11/2009 | Alvarado | A47F 13/085 211/85.15 |
| 2010/0067831 | A1* | 3/2010 | Alvarado | B65D 33/001 221/45 |
| 2017/0055727 | A1* | 3/2017 | Tan | B65D 33/001 |

* cited by examiner

HANGING BAG DISPENSER

FIELD OF INVENTION

This invention relates to the field of dispensing systems for plastic and other film bags and more specifically to dispensers for vertically hung bags and bag packs with hanging apertures.

BACKGROUND OF THE INVENTION

As mounting space is usually at a premium in supermarkets and grocery stores, it is desirable to have bag dispensing systems that use a minimum of such space, are adaptable to a variety of dispenser mounting systems and provide means for keeping bags neat and orderly in the store. It is also desirable that the supply of bags remaining in the dispenser be readily visible to service personnel so that bag supplies can be timely maintained. In order to dispense bags economically and environmentally, it is desirable that only a single bag is dispensed at one time and that the bag remains in the hand of the user as it is dispensed.

Thin film produce bags have often been dispensed from roll mounted bag systems. These systems are typically used for fresh produce, and can help with limited space problems when they are designed to use folded bags. These relatively large bags are folded two to four times along vertical or horizontal axes and then formed into compact rolls. The bags are typically joined to one another using perforations. Some bags, known as star-sealed bags are folded twice and then sealed across their bottom edges. This produces a bag with an extremely strong bottom.

However, when using roll mounted bags, it is critical that the bags are correctly loaded into the bag dispenser and that the bag roll cannot accidently leave the dispenser when a user attempts to pull a bag from the roll. Should this happen, the bag roll could end up on the floor of store, providing a potentially hazardous condition. It is even possible for a bag roll to fly out of the dispenser and strike a grocery patron when he attempts to pull a bag from the roll. In order to obviate these problems, the present invention dispenses bags from a vertically oriented hanging bag stack. These compact dispensers occupy a relatively small footprint in a retail store, eliminate the danger of loose bag rolls, and also eliminate the need to open a folded bag. These dispensers provide a compact system that is easy and safe to use as well as being easy to maintain and economical to use. Some examples of dispensers for hanging bags and related inventions include the following.

U.S. Pat. No. 6,729,483, issued to Nguyen et al., discloses a thermoplastic bag dispensing system for use in dispensing thermoplastic bags from a stack. The dispenser comprises a vertical support rod supporting planar surface in top rack which serves as a horizontal support surface. Support members in the form of spikes extend from the horizontal surface to receive a bag pack through openings provided at the upper edge of that bag pack. The bag pack thus hangs via the support members from the horizontal support surface and over a declined (inclined) support surface. A pivotally mounted bag pack support member is also mounted on the horizontal support surface and may be raised in order to mount the bag pack then lower it into position over the bags. Since the bags within bag pack are of the self-opening type, as the top bag is removed from a dispenser the immediately following bag is pulled into an open position and prepared for subsequent dispensing.

U.S. Pat. No. 8,960,493, issued to Dennison et al., is directed to a method and apparatus for disposable glove dispensing. The glove is dispensed one at a time while providing for a second member to be opened when the first member is removed.

U.S. Pat. No. 8,496,134, issued to Springer et al., illustrates a pet waste bag dispenser. The reference discloses an example of a plastic bag dispenser system that utilizes a positioner, or stabilizer, in order to keep individual bags of a pack conveniently stacked for removal of one bag at a time.

U.S. Patent Application No. 2015/00883677, published for Tan, is directed to a bag dispenser rack that incorporates mounting spikes and pivotally mounted support surface to keep the bags in order, while providing for dispensing of individual bags from a pack with the following bag brought conveniently into open configuration for use thereafter.

U.S. Pat. No. 6,502,371, issued to DeMatteis, illustrates the process of die-cutting bag stacks to form individual bag tops, die-cut handle apertures, or other mounting apertures, die blade configurations forming the vent lines of an array of vent apertures are also used to bond the outer surfaces of the front and rear bag walls together. The die-cutting operation selectively bonds the successive front and rear bag walls together at or adjacent the cut edges of the vent lines, thereby allowing the bags in a bag stack to subsequently self-open when dispensed.

U.S. Pat. No. 6,446,811, issued to Wilfong, Jr., discloses a pack of self-opening serially-arranged plastic bags of the "star-seal" type defining eight superimposed wall layers in the bag. Mounting tabs form a part of top portions of each of the eight layers and are positioned in superimposed positions and each includes an aperture for mounting the tabs on a tab retaining device of a rack in a non-front-side-free manner. Each of the tabs includes a mechanism for rendering the tab detachable and providing a predetermined detaching strength. In one embodiment, each of the tabs are detachable from the rack and in another embodiment, each of the tabs are detachable from the bag. A frangible bond is formed between the rear layer and the front layer of each successive bag in the pack. This frangible bond has a predetermined strength (1) which is greater than the predetermined detaching strength of two of the tabs and (2) is weaker than the predetermined detaching strength of the remaining six tabs to allow the leading bag of the pack (when pulled by a user for removal) to disengage from the pack, while (before disengagement) pulling the succeeding bag in the pack to cause detaching of the two leading of the tabs for self-opening of the succeeding bag.

International Application No. WO2016134003, published for DeMatteis, is directed to a bag suspending base with a mounting surface constructed to be secured to a support surface. The base has an outwardly facing profile when mounted to the support surface. The outwardly facing profile is at least partially defined by an upper perimeter and an opposing lower perimeter. The upper perimeter is constructed to suspend a plurality of bags. Each bag has a front panel with a front handle defining a front handle aperture and a rear panel with a rear handle defining a rear handle aperture aligned with the front handle aperture. The dispenser has a bag retainer that extends upwardly from the upper perimeter of the base to define an upper handle retention member with a rearwardly facing bag handle surface and further extending downwardly from the lower perimeter of the base to define a lower handle retention member with a second rearwardly facing bag handle surface. The retention members defines a slightly enlarged outwardly facing retainer profile relative to the outwardly facing profile of the base. The bag retainer is constructed to slidably receive a plurality of bag handles over the upper and lower retention members to locate the bag handles between the retention members and the support surface when the base is mounted thereon. The bag retainer is further constructed to permit withdrawal of a front handle of a single bag from the bag retainer and the base when the front handle is pulled away in a first direction from the bag retainer without any lifting motion while releasably retaining the rear handle of the same bag on the base at least partially behind at least one retention member to space apart the front and rear handles of the corresponding bag and present an open loaded configuration wherein the bag may be loaded with one or more items and then further released completely from the base and retainer by pulling the bag again in the same direction as the first direction.

Great Britain Patent No. 2309216, published for Mason, describes a dispenser in which a bundle of plastic bags is releasably connected to each other by a spot adhesive are loaded onto the dispenser. To mount the tabs of each bag onto the mounting hook, the bag restraining arm must first be lifted up against the spring bias of a retaining spring and the hook pivoted to the left or right to move it out of the way to enable the holes in the tabs to be fitted onto the hook. When the bundle of bags has been loaded onto the dispenser and the tabs are all fitted onto the hook, the bag restraining arm is pivoted back to its original position and released so that it drops back into position over the tabs and positively and securely retains the tabs of the plastic bags on the hook and axial movement of the tabs along the loop is prevented. In addition, the retaining arm also prevents overloading of the dispenser because too many bags cannot be loaded onto the dispenser at once otherwise it becomes impossible to return the retaining arm to its central position.

U.S. Pat. No. 6,585,197, published for Daniels, is directed to a dispenser that includes the following components. An upward pointing hanging means that has upper and lower ends and is sized and shaped to fit slidably through an opening in the bag mounting tabs. A positioning bar that has first and second ends and is positioned horizontally at a first predetermined distance from the hanging means. Means for supporting the hanging means are provided, as are means for supporting the positioning bar. When bags are suspended from the hanging means at the tabs and located over the positioning bar, the bags will be positioned for individual dispensing. In one variant of the invention a lower bag end guard has a first end, a second end and a first predetermined height. The lower bag end guard is located parallel to the positioning bar at a level sufficient to prevent access to lower ends of the bags. When the bags are suspended from the hanging means and located over the positioning bar with the lower ends behind the lower bag end guard, a bag user will not pull the bags from their lower ends and thus be prevented from obtaining more than one bag at a time.

U.S. Pat. No. 6,264,059, published for Requena, discloses a plastic bag dispensing apparatus which includes a bag stand which includes at least one support hook. The plastic bag dispensing apparatus includes a bag stack which is formed with a disposable upper portion and a lower bag portion. The upper portion of bag stack includes at least one hole associated therewith for enabling the bag stack to be removably mounted on the support hook or hooks of the bag stand. The bag shield has a planar front. At least one hole is formed in the shield for mounting the shield on the support hook of the bag stand. The bag shield has two substantially circular holes formed near the top for mounting the shield on the support hooks. An opening is formed through the shield. The opening has an upper portion which is substantially circular in shape. The opening also includes a vertical elongate portion. The substantially circular portion of opening is on top of and contiguous with vertical elongate portion.

U.S. Application No. 2005/0269349, published for Daniels, discloses a dispenser that includes a downward pointing projection. The projection is sized and shaped to fit slidably through a bag opening opening in a bag mounting tab. A support bar has first and second ends and is located horizontally above the projection. When the plurality of bags are suspended from the projection at the tab and located over the support bar, the bags will be positioned for individual dispensing.

U.S. Pat. No. 5,092,548, published for Bayes, is directed to a dispenser having a bag separating member that is attached to both the midportion of a bag supporting bar and the face of a U-shaped bar. The separating member is preferably an elongated ring having a lower region extending beyond the face of the U-shaped bar as well as beyond the plane of subsections and of a horizontal bar, and having an upper region located between the midportion and a mounting plate. The lower region extends outwardly, preferably at an angle of about 45 degrees to the plane formed by the U-shaped bar and a shoulder bar.

When a first bag is removed from the dispenser, the retaining arm prevents more than one bag from being removed at a time as the tab on the rear face of the second bag and the tabs on the third and fourth bags are prevented from being pulled off the hook before the adhesive between the rear face of a first bag and the front face of a second bag breaks, because the tabs are retained securely on the hook and prevented from moving forwardly by the retaining arm.

It is an objective of the present invention to provide a bag dispensing system that provides large size film bags that are dispensed from a system that occupies a minimum of floor space in a retail store. It is a further objective to provide a system that does not require roll mounted bags. It is a still further objective of the invention to provide a dispensing system adaptable to a variety of different mountings. It is yet a further objective to provide such a system that provides a visual indication of the need to refill the dispenser. It is still a further objective to provide a dispenser that can accommodate multiple bag sizes. It is yet a further objective to provide a dispenser that limits dispensing to a single bag at one time while being quick and easy to load with a fresh supply of bags. Finally, it is an objective of the present invention to provide a bag dispensing system that is durable, inexpensive, easy to keep clean and simple to use.

While some of the objectives of the present invention are disclosed in the prior art, none of the inventions found include all of the requirements identified.

SUMMARY OF THE INVENTION

The present invention addresses all of the deficiencies of prior art hanging bag dispensers and satisfies all of the objectives described above.

(1) A hanging bag dispenser providing the desired features may be constructed from the following components. A bag support platform is provided. The platform provides a surface. The surface contacts a last bag in a vertically supported bag pack. The bag pack has a first predetermined width and a first predetermined length. At least one mounting device is provided. The device is attached to the bag support platform and is sized, shaped and located to engage a mounting aperture. The aperture penetrates each bag in the bag pack. A positioning system is provided. The system is attached to the bag support platform and maintains the bag support platform at a height sufficient to allow the bag pack to extend downwardly for at least the first predetermined length. At least one pivotally mounted bag control arm is provided. The bag control arm is mounted to the bag support platform and is sized shaped and located to permit installation of the bag pack on the at least one mounting device when pivoted to a loading position and located to constrain an outermost bag in the bag pack when pivoted to a control position.

At least one guard plate is provided. The at least one guard plate is mounted adjacent the at least one pivotally mounted bag control arm. The guard plate prevents access to an upper portion of bags in the bag pack when the pivotally mounted bag control arm is pivoted to the control position. The at least one guard plate having at least one access notch, the at least one access notch being located to provide clearance for the at least one mounting device. The at least one access notch permitting viewing of the at least one mounting device and the bag pack to determine a number of bags remaining in the dispenser.

(2) In a variant of the invention, at least one mounting device is upwardly and rearwardly angled.

(3) In another variant, the at least one mounting device includes a bendable tab.

(4) In still another variant, the at least one mounting device includes an angled hook.

(5) In yet another variant, the at least one pivotally mounted bag control arm rests upon the outermost bag in the bag pack when pivoted to the control position.

(6) In a further variant, the positioning system is selected from the group comprising floor stands, wall mounts, surface mounts, shelf mounts, glue, screws, nails and looping and hooking fasteners (Velcro®).

(7) In still a further variant, first and second horizontal control arms are provided. The control arms are attached either to or adjacent to the bag support platform and are sized, shaped and located to align with hanging apertures located in handles of a T-shirt style bag.

(8) In a variant of the invention, a surrounding control device is provided. The device is attached to either the bag support platform or the positioning system. The cage is sized shaped and located to surround at least a lower portion of the bag pack, thereby preventing a user from pulling a bag from a lower portion of the bag.

(9) In another variant, the control device is of wire form construction.

(10) In yet another variant, the control device is formed of wood, plastic or metal.

(11) In still another variant, the support platform includes either of a vertical and angled planar surface.

(12) In a further variant, the support platform is horizontally oriented and has either a cylindrical or convex curved surface.

(13) In still a further variant, the support platform has a canopy-style angled bag support surface.

(14) In yet a further variant, the at least one mounting device is a mounting spike having an angled portion adjacent a distal end of the spike.

(15) In another variant of the invention, the at least one mounting device is slidably mounted to the bag support platform and adapted to accommodate bags having a variety of differently located mounting apertures.

(16) In still another variant, the at least one mounting device is a mounting hook.

(17) In yet another variant, the mounting hook is slidably mounted to the bag support platform and adapted to accommodate bags having a variety of differently located mounting apertures.

(18) In a further variant, the positioning system is any of a floor stand, a counter mount and a surface stand. The positioning system is adapted to support at least two of the bag support platform.

(19) In still a further variant, the positioning system is a wall mount. The wall mount supports the bag support platform.

(20) In yet a further variant, the positioning system is a counter mount. The counter mount supports the bag support platform.

(21) In another variant of the invention, the at least one pivotally mounted bag control arm contacts the outermost bag of the bag pack at a single point.

(22) In still another variant, the at least one pivotally mounted bag control arm includes a pair of control arms. The control arms contact the outermost bag of the bag pack at two points.

(23) In a further variant, the at least one pivotally mounted bag control arm includes at least one weight. The weight provides increased friction between the control arm and the outermost bag.

(24) In still a further variant of the invention, the at least one pivotally mounted bag control arm includes first and second bag control elements. The first and second elements are attached to a pivot rod. The pivot rod is slidably located within a bearing structure. The bearing structure is attached to the bag support platform.

(25) In yet a further variant, the bag further includes a central handle, the central handle selected from the group that includes round, oval, kidney-shaped and racetrack (elongated round).

(26) In another variant of the invention, the bag further includes a top seam, a bottom seam, a U-shaped cut-out commencing at the top seam, extending downwardly toward the bottom seam, proceeding across the bag and rejoining the top seam, a central hanging aperture, the top seam and bag material adjacent the U-shaped cut-out forming first and second bag handles, the bag handles has first and second hanging apertures located in an upper portion of the handles.

(27) In still another variant, the bag further includes at least one side gusset.

(28) In yet another variant, the bag pack further includes self-opening bags. The self-opening bags employ technology selected form the group comprising: corona treatment, corona treatment with pressure, knife cutting, adhesives, hot staking, cold pinning, special material formulations and adhering inks.

(29) In a further variant, the special material formulation includes 40-48 wt. % high density, high molecular weight polyethylene, 12-20 wt. % high density, medium molecular weight polyethylene, 20-30 wt. % linear low density polyethylene, 0-8 wt. % color concentrate.

(30) In still a further variant, the special material formulation further includes 0.5 wt. % slip and antiblock compound.

(31) In yet a further variant, the special material formulation further includes 1-3 wt. % calcium carbonate.

(32) In another variant of the invention, the special material formulation further includes 10-20 wt. % recycled material, the recycled material comprising about 40-48 wt. % high density, high molecular weight polyethylene, 12-20 wt. % high density, medium molecular weight polyethylene, 20-30 wt. % linear low density polyethylene, 0-8 wt. % color concentrate.

(33) In still another variant, 10-15 wt. % of the linear low density polyethylene has a density ranging from 0.923-0.924 gm/cc.

(34) In yet another variant, 10-15 wt. % of the linear low density polyethylene has a melt index ranging from 0.25-0.30 gm/10 minutes.

(35) In a further variant, the high density, medium molecular weight polyethylene has a density ranging from 0.937-0.947 gm/cc.

(36) In still a further variant, the high density, medium molecular weight polyethylene has a melt index ranging from 0.10-0.30 gm/10 minutes.

(37) In yet a further variant, a central mounting hook and first and second horizontal control arms are provided. The mounting hook and the control arms are attached either to or adjacent to one of the at least two of the bag support platforms. The mounting hook and the first and second horizontal control arms are sized, shaped and located to align with hanging apertures located in bag material adjacent a U-shaped cut-out and handles of a T-shirt style bag, respectively.

(38) In another variant of the invention, the positioning system supports two bag support platforms. The platforms are located at right angles to each other.

(39) In still another variant, the dispenser includes at least one removable surrounding control device. The device is attached to either the bag support platform or the positioning system. The device is sized shaped and located to surround at least a lower portion of the bag pack, thereby preventing a user from pulling a bag from a lower portion of the bag.

(40) In yet another variant, the at least one guard plate includes a first guard plate, located between a first pivotally mounted bag control arm and a first mounting device, a second guard plate, located between the first mounting device and a second mounting device, and a third guard plate mounted between the second mounting device and a second pivotally mounted bag control arm.

(41) In another variant of the invention, the at least one guard plate includes a first side guard plate, disposed between a first pivotally mounted bag control arm and a central mounting device and a second side guard plate, located between the central mounting device a second pivotally mounted bag control arm.

(42) In still another variant, the at least one guard plate is attached to a mounting loop. The mounting loop is attached at a first end to the first pivotally mounted bag control arm and attached at a second end to the second pivotally mounted bag control arm.

(43) In yet another variant, the bag support platform includes a horizontal portion and a vertical portion. The at least one mounting device is located upon the horizontal portion and the at least one pivotally mounted bag control arm is located to constrain the bag pack between the bag control arm and the vertical portion.

(44) In a further variant, the at least one mounting device includes at least one folded metal pin. The folded metal pin is angled backwardly and attached to the horizontal portion.

(45) In still a further variant, the surrounding control device includes a central opening. The central opening permits access to a central portion of a front surface of the outermost bag.

(46) In yet a further variant, the at least one mounting device is located upon the horizontal portion at an angle ranging from 30° to 45° to the horizontal.

(47) In a final variant, the bag pack mounted on the at least one mounting device will have a first tension point adjacent the at least one mounting device and a second tension point at an intersection of the horizontal portion and the vertical portion. The first and second tension points will augment self-opening features of bags in the bag-pack.

An appreciation of the other aims and objectives of the present invention and an understanding of it may be achieved by referring to the accompanying drawings and the detailed description of a preferred embodiment.

DESCRIPTION OF THE DRAWINGS

FIG. 3A is a partial perspective view of the FIG. 1 embodiment illustrating a convex bag support platform and the bag control arm in the loading position;

FIG. 3B is a partial perspective view of the FIG. 1 embodiment illustrating a mounting hook attached to an angled bag support platform;

FIG. 3C is a partial perspective view of the FIG. 1 embodiment illustrating a bendable tab mounting device;

DETAILED DESCRIPTION OF THE PREFERRED EMBODIMENT (1) A hanging bag dispenser 10 providing the desired features may be constructed from the following components. As illustrated in FIGS. 1-10, bag support platform 14 is provided. The platform 14 provides a surface 18. The surface 18 contacts a last bag 22 in a vertically supported bag pack 26. The bag pack 26 has a first predetermined width 30 and a first predetermined length 34. At least one mounting device 38 is provided. The device 38 is attached to the bag support platform 14 and is sized, shaped and located to engage a mounting aperture 42. The aperture 42 penetrates each bag 46 in the bag pack 26. A positioning system 50 is provided. The system 50 is attached to the bag support platform 14 and maintains the bag support platform 14 at a height 54 sufficient to allow the bag pack 26 to extend downwardly for at least the first predetermined length 34. At least one pivotally mounted bag control arm 58 is provided. As illustrated in FIGS. 3A and 4A, the bag control arm 58 is mounted to the bag support platform 14 and is sized shaped and located to permit installation of the bag pack 26 on the at least one mounting device 38 when pivoted to a loading position 62 and located to constrain an outermost bag 66 in the bag pack 26 when pivoted to a control position 70.

Figure 1:
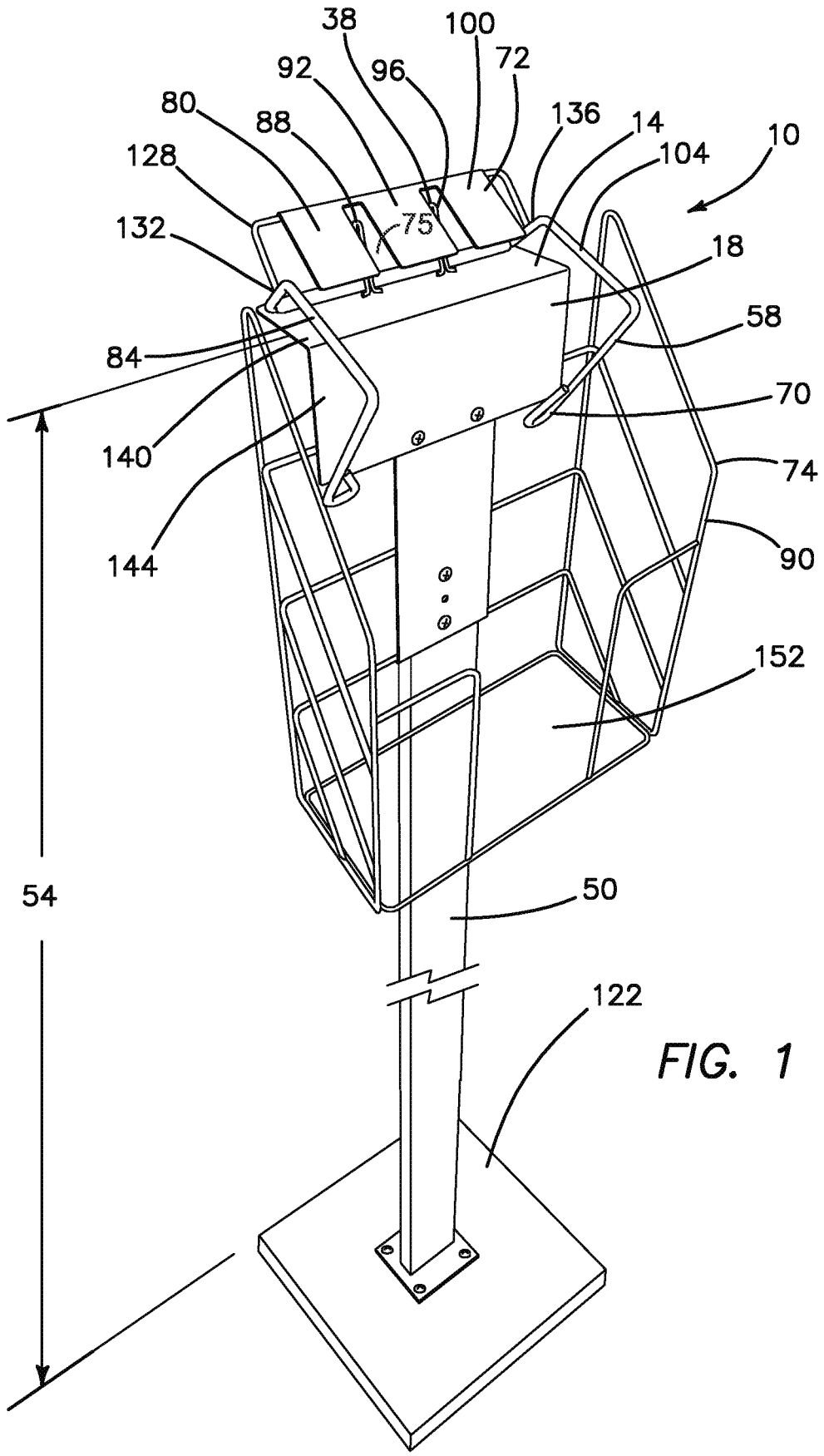
FIG. 1 is a perspective view of the preferred embodiment of the invention illustrating the dispenser with guard plates and surrounding control device attached to a floor mounting.

At least one guard plate 72 is provided. The at least one guard plate 72 is mounted adjacent the at least one pivotally mounted bag control arm 58. The guard plate 72 prevents access to an upper portion 76 of bags 66 in the bag pack 26 when the pivotally mounted bag control arm 58 is pivoted to the control position 70. The at least one guard plate 72 having at least one access notch 75, the at least one access notch 75 being disposed to provide clearance for the at least one mounting device 38, permitting viewing of the at least one mounting device 38 and said bag pack 26 to determine a number of bags 22 remaining in said bag pack 26 in the dispenser 10.

(2) In a variant of the invention, at least one mounting device 38 is upwardly angled.

Figure 3:
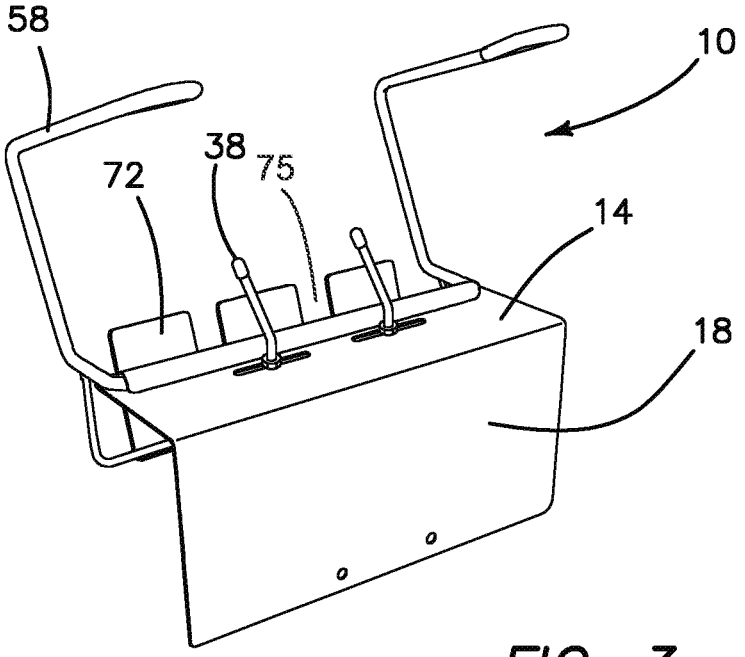
FIG. 3 is a perspective view of the FIG. 1A embodiment illustrating slidably attached mounting device attached to a horizontal surface of the bag support platform.
Figure 3A:
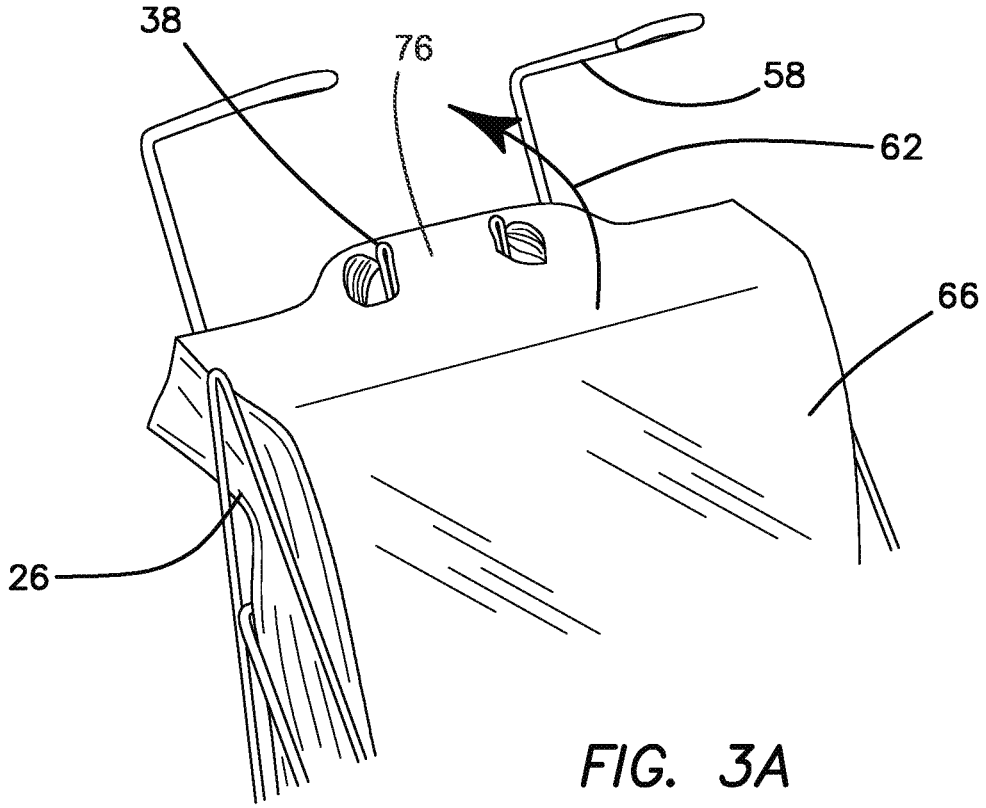
FIG. 3A is a partial perspective view of the FIG. 1A embodiment illustrating the control arms in the loading position.
Figure 3B:
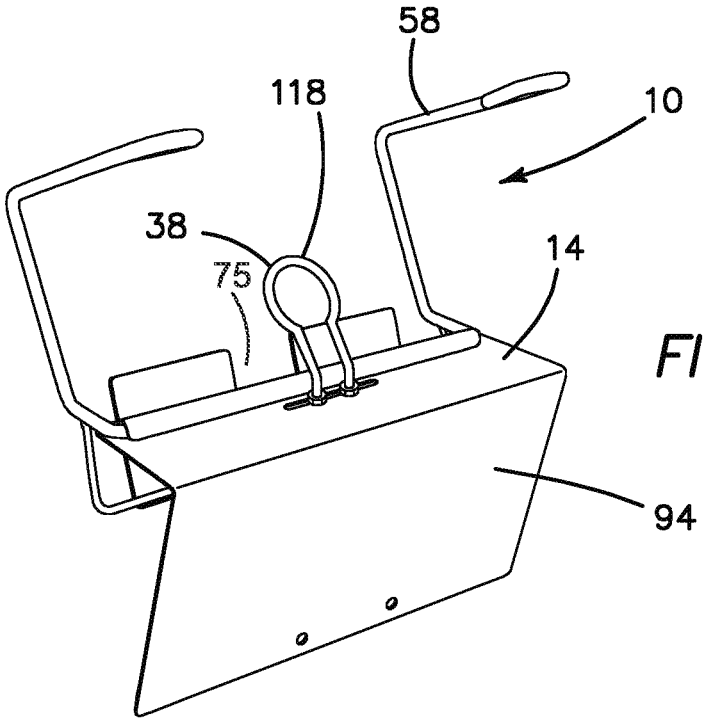
FIG. 3B is a perspective view of the FIG. 1A embodiment illustrating an angled mounting hook attached to a horizontal surface of the bag support platform.
Figure 3C:
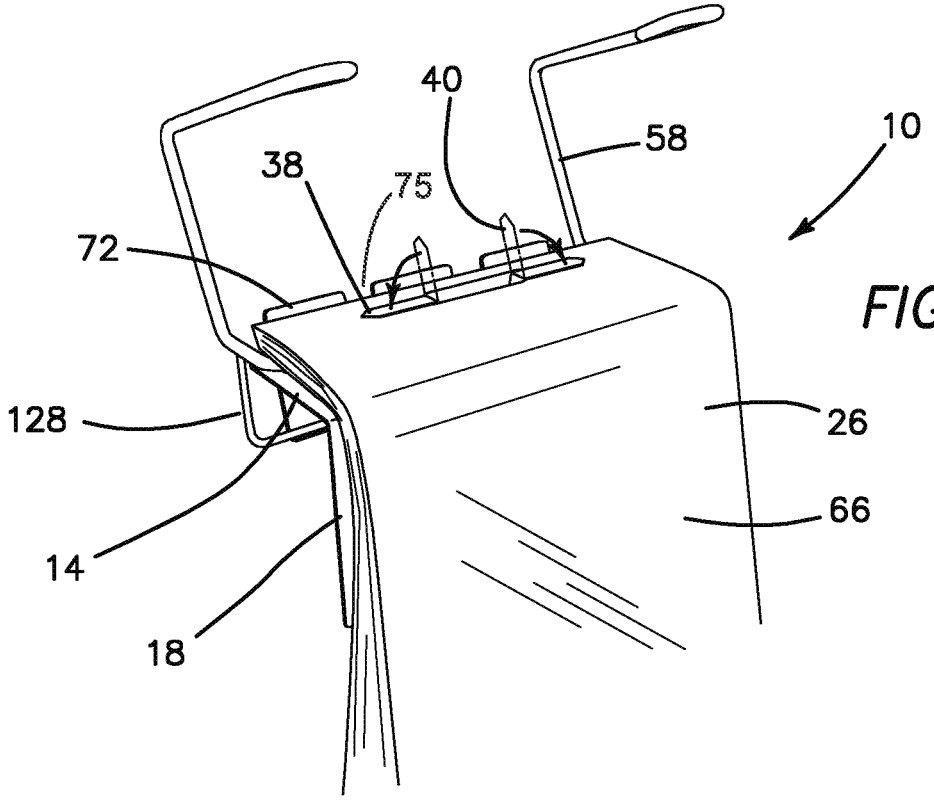
FIG. 3C is a partial perspective view of the FIG. 1 embodiment illustrating a bendable tab mounting device; illustrating a cylindrical bag support platform with slidably attached mounting spikes.

(3) In another variant, as illustrated in FIG. 3C, the at least one mounting device 38 includes a bendable tab 40.

(4) In still another variant, as illustrated in FIGS. 1D, 1E, 3E, 3F and 4E, the at least one mounting device 38 includes an angled hook 44.

(5) In yet another variant, as illustrated in FIGS. 1G, 2A, 2D and 4A, the at least one pivotally mounted bag control arm 58 rests upon the outermost bag 66 in the bag pack 26 when pivoted to the control position 70.

(6) In a further variant, as illustrated in FIGS. 1, 1A, 1B, 1C, 1F, 1G, 111, 2A, 2B, 2C, 2D, 4F, 7, 7A and 10, the positioning system 50 is selected from the group comprising floor stands 122, wall mounts 126, surface mounts (not shown), counter mounts 130, glue (not shown), screws 52, nails (not shown) and looping and hooking fasteners (Velcro®) 56.

Figure 1A:
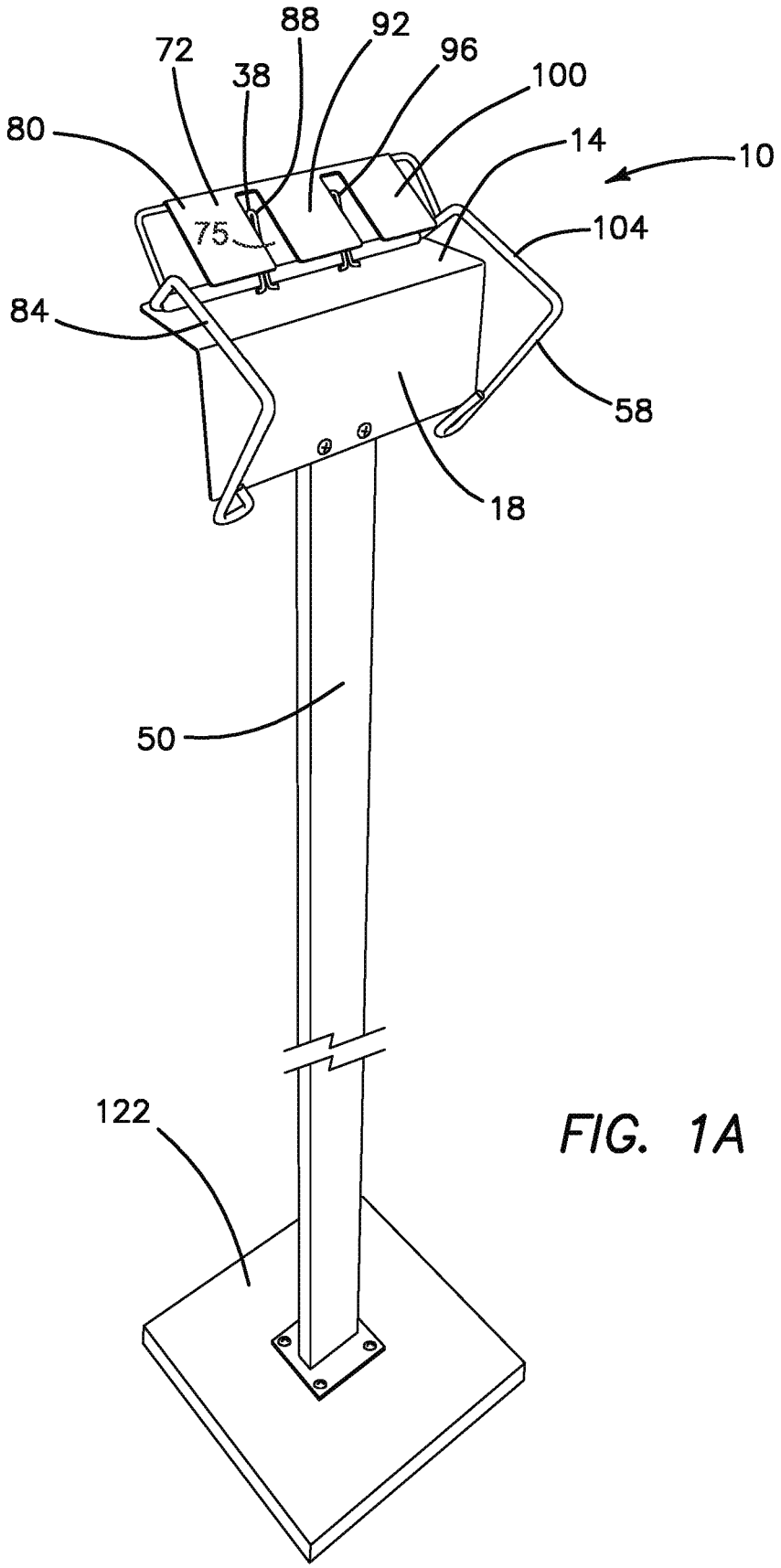
FIG. 1A is a perspective view of the FIG. 1 embodiment without the surrounding control device.
Figure 1B:
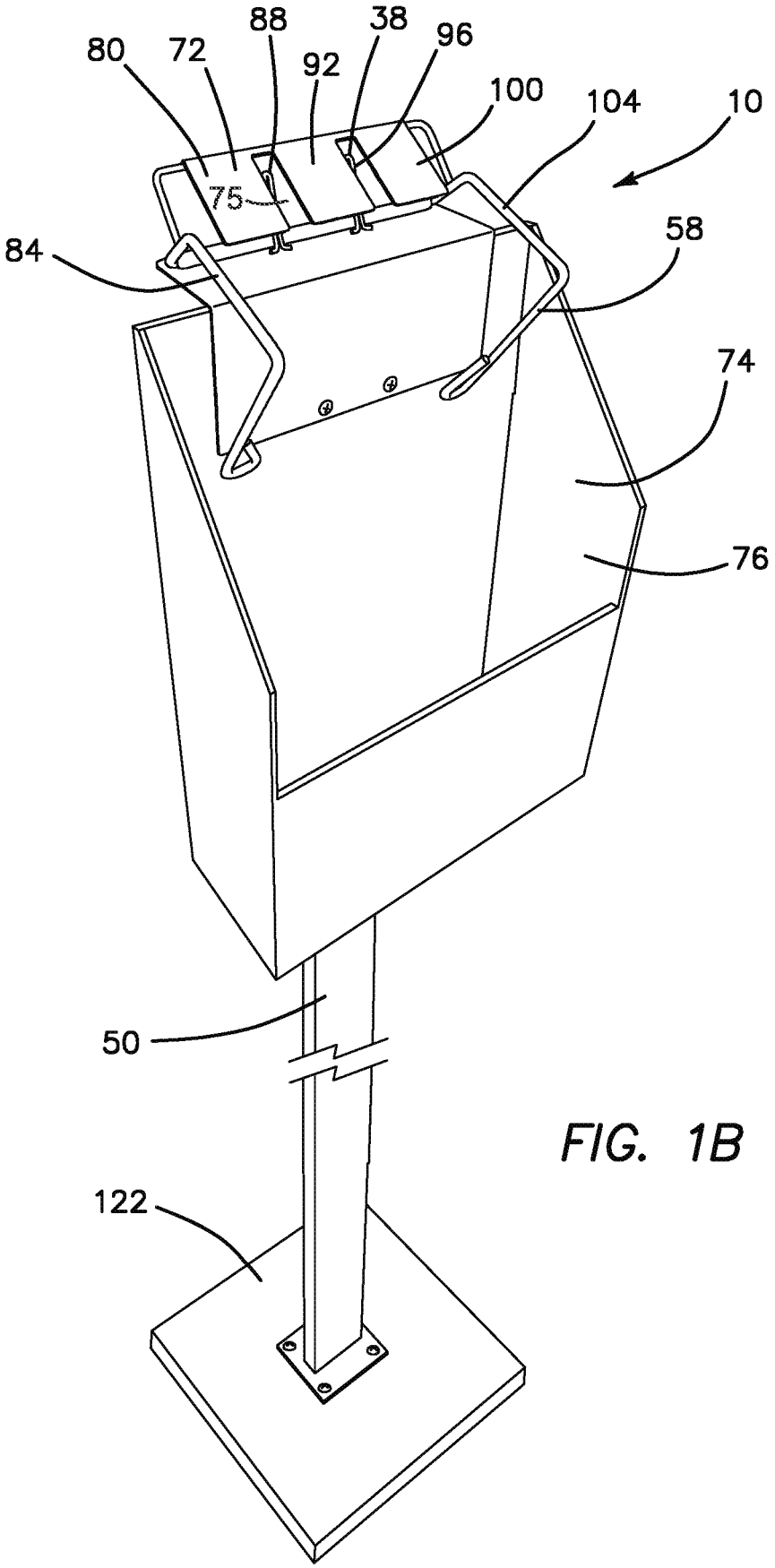
FIG. 1B is a perspective view of the FIG. 1 embodiment with a plastic surrounding control device.
Figure 1C:
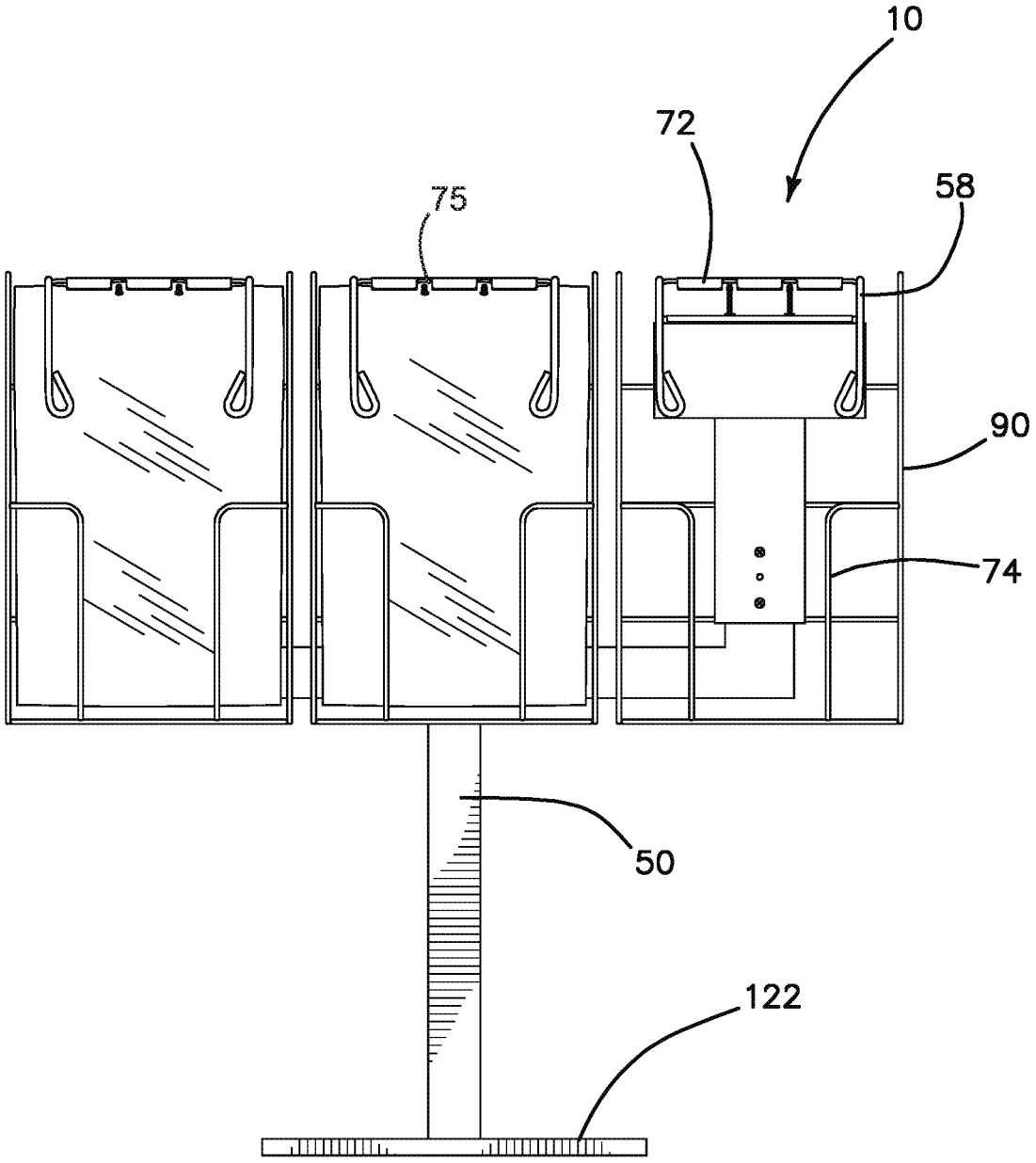
FIG. 1C is a perspective view of the FIG. 1 embodiment illustrating the positioning system supporting three bag support platforms.
Figure 1D:
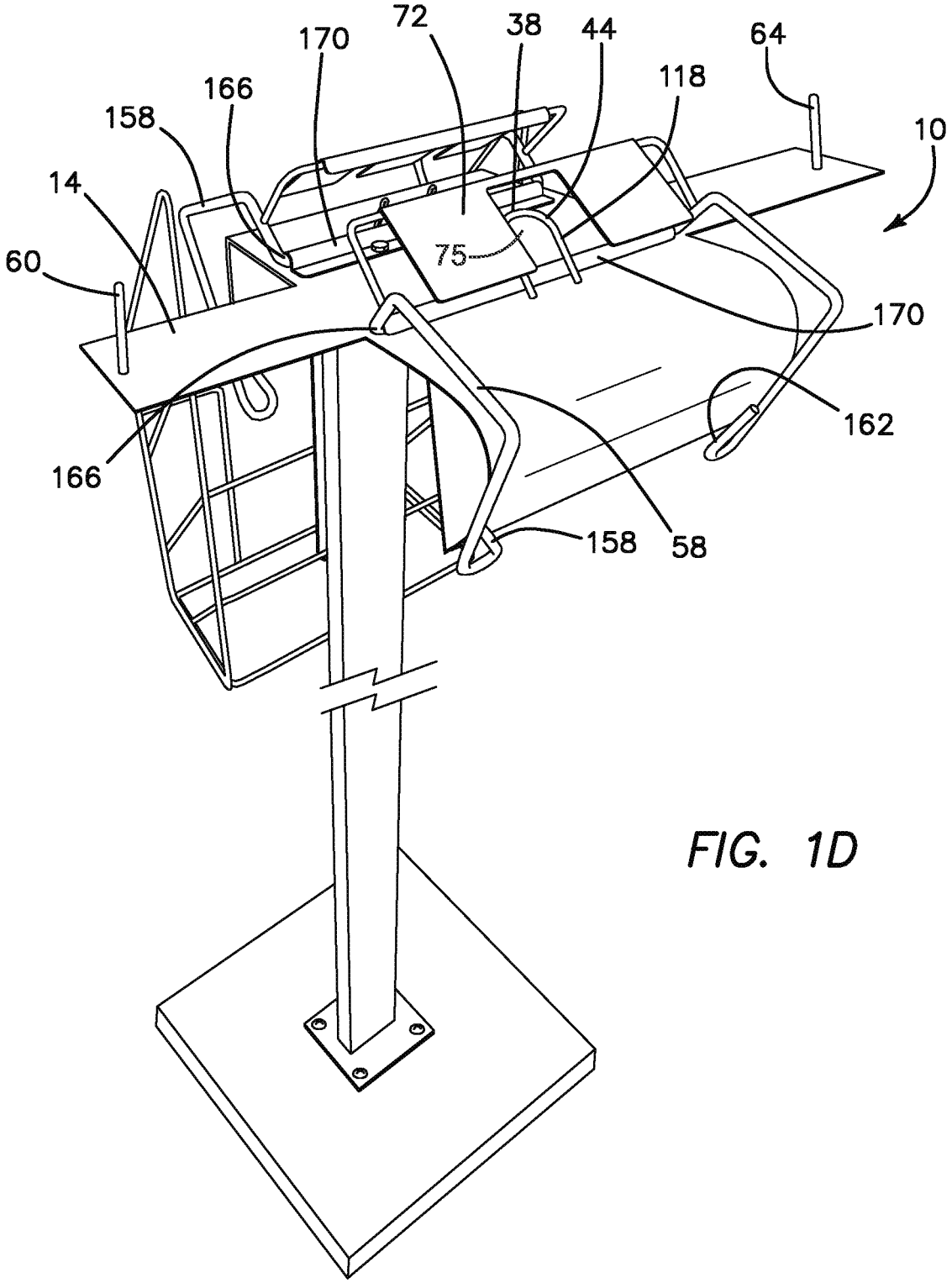
FIG. 1D is a perspective view of the FIG. 1 embodiment illustrating the positioning system supporting two bag support platforms, one adapted for use with T-shirt style bags.
Figure 1E:
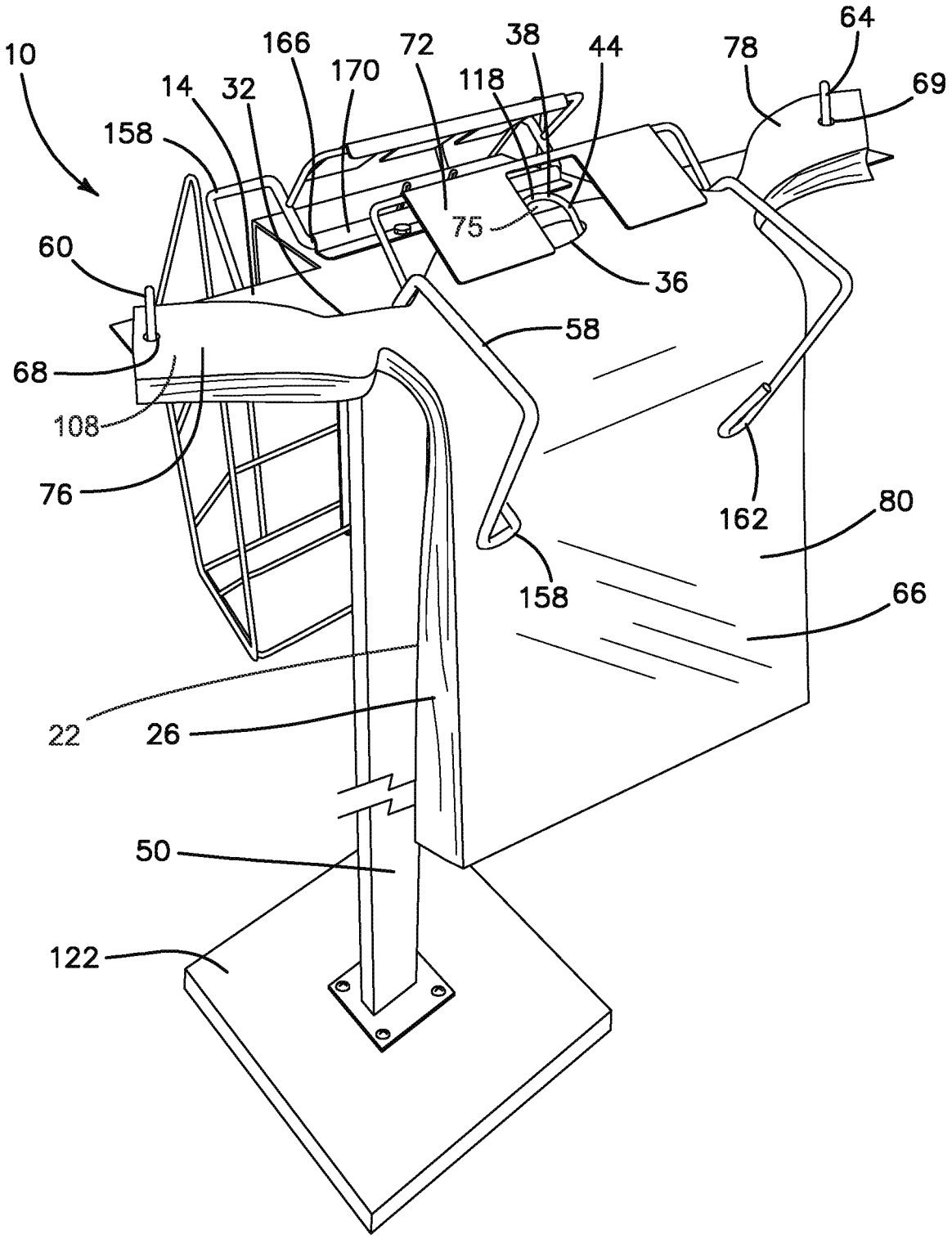
FIG. 1E is a perspective view of the FIG. 1 embodiment with a pack of T-shirt bags mounted on the dispenser.
Figure 3D:
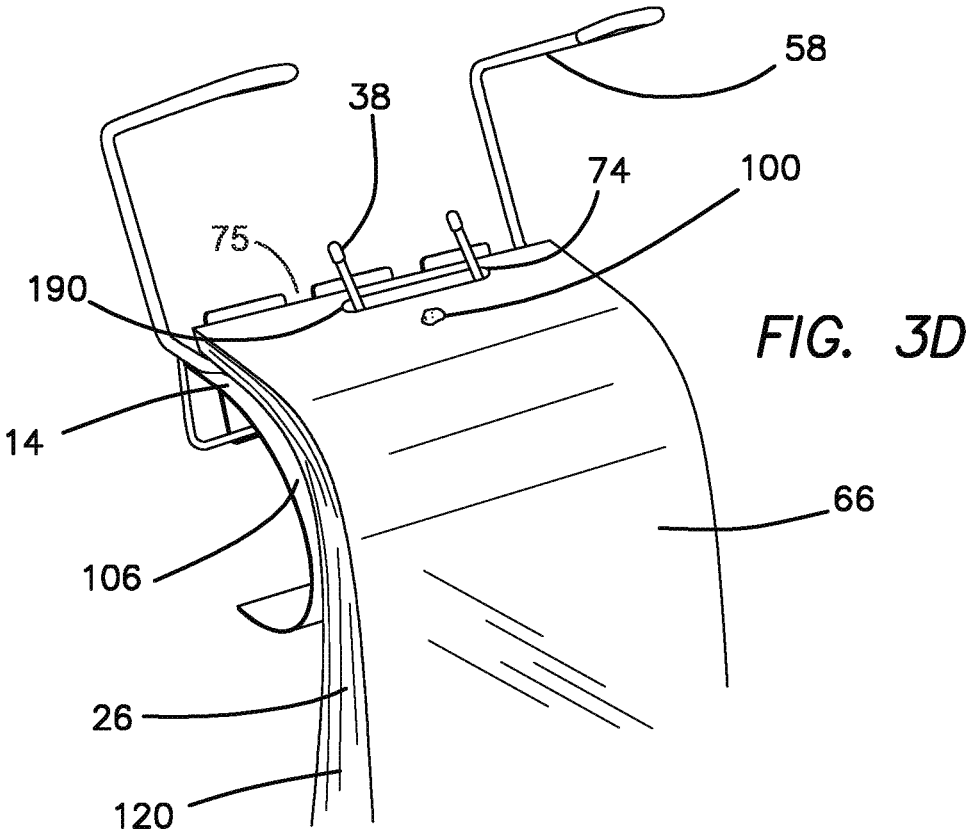
FIG. 3D is a partial perspective view of the FIG. 1A embodiment illustrating the control arms in the loading position, a convex bag support platform and a race track handled bags and a glue spot adhesion means.
Figure 4D:
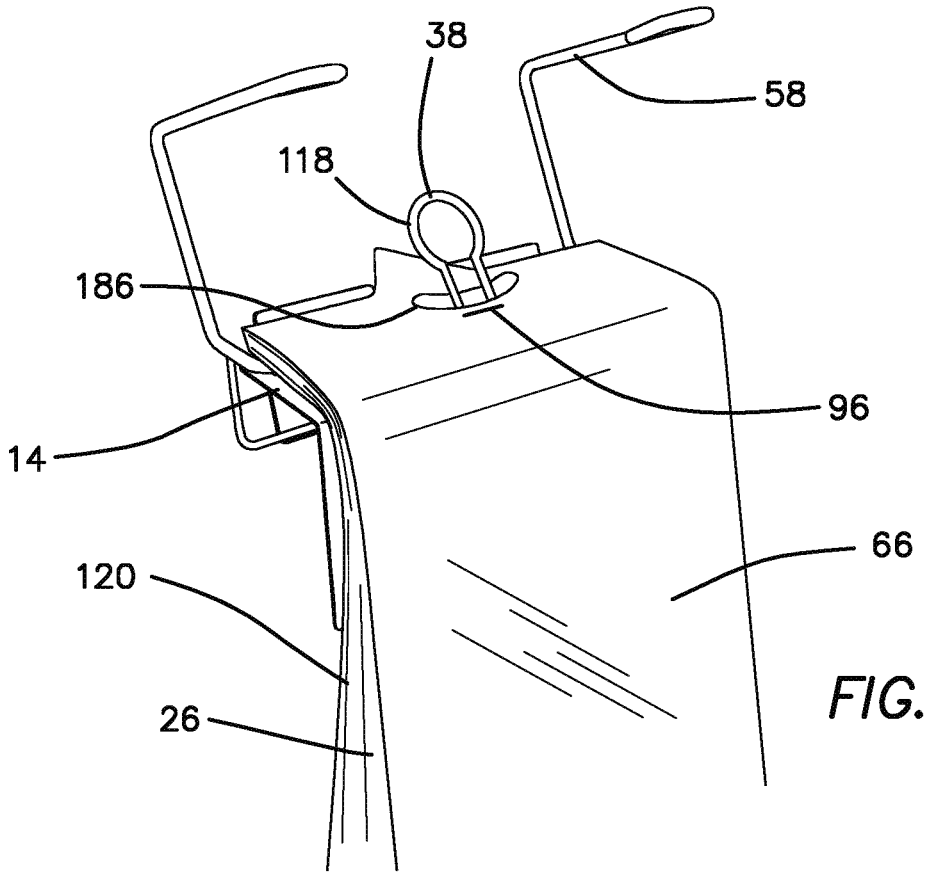
FIG. 4D is a partial perspective view of the FIG. 1A embodiment illustrating the control arm in the loading position and bags with kidney-shaped handle opening and a knife cut adhesion means.
Figure 3E:
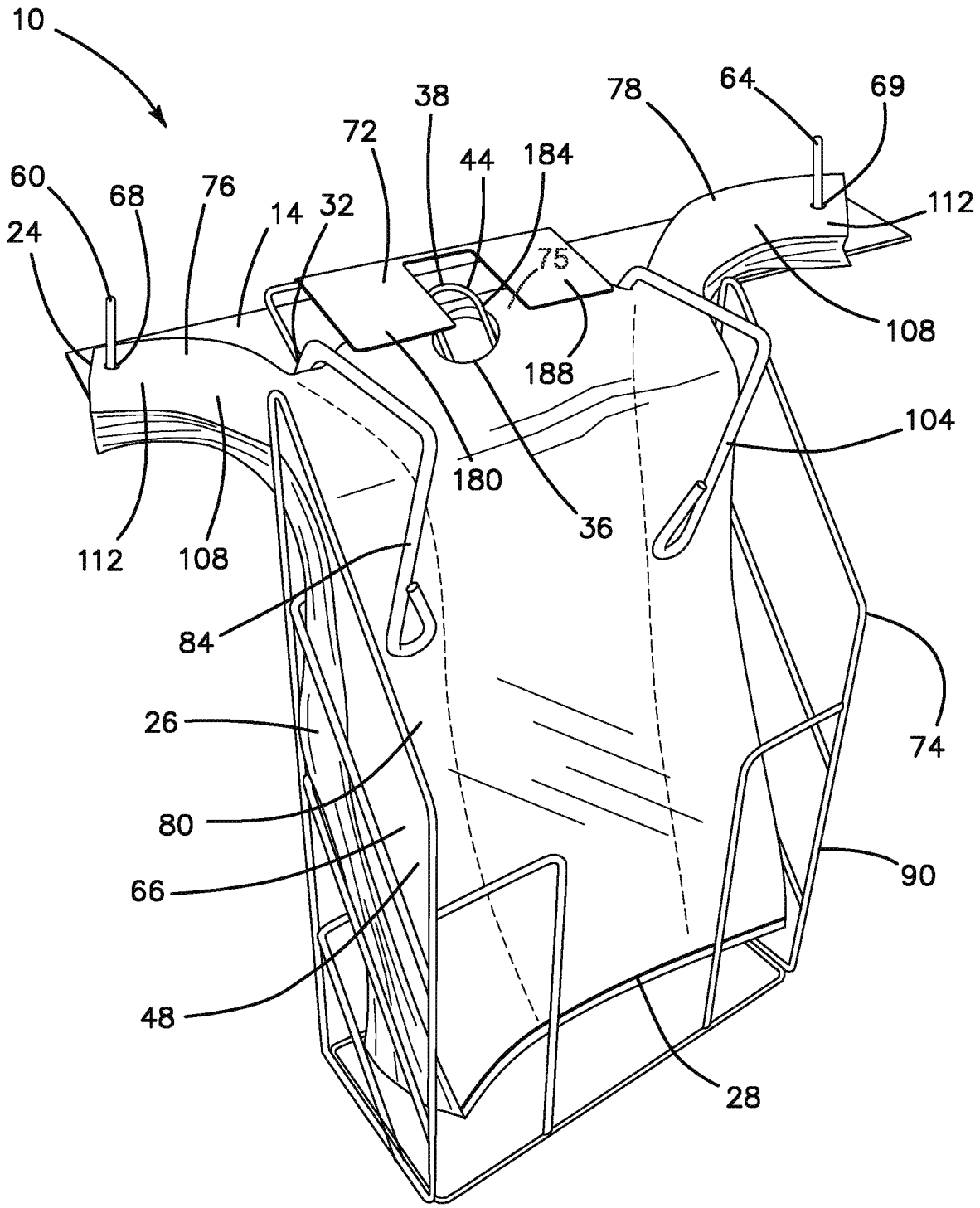
FIG. 3E is a perspective view of the FIG. 1 embodiment illustrating a dispenser adapted for T-shirt-style bags having a central round bag support aperture fitted over an angled mounting hook.
Figure 3F:
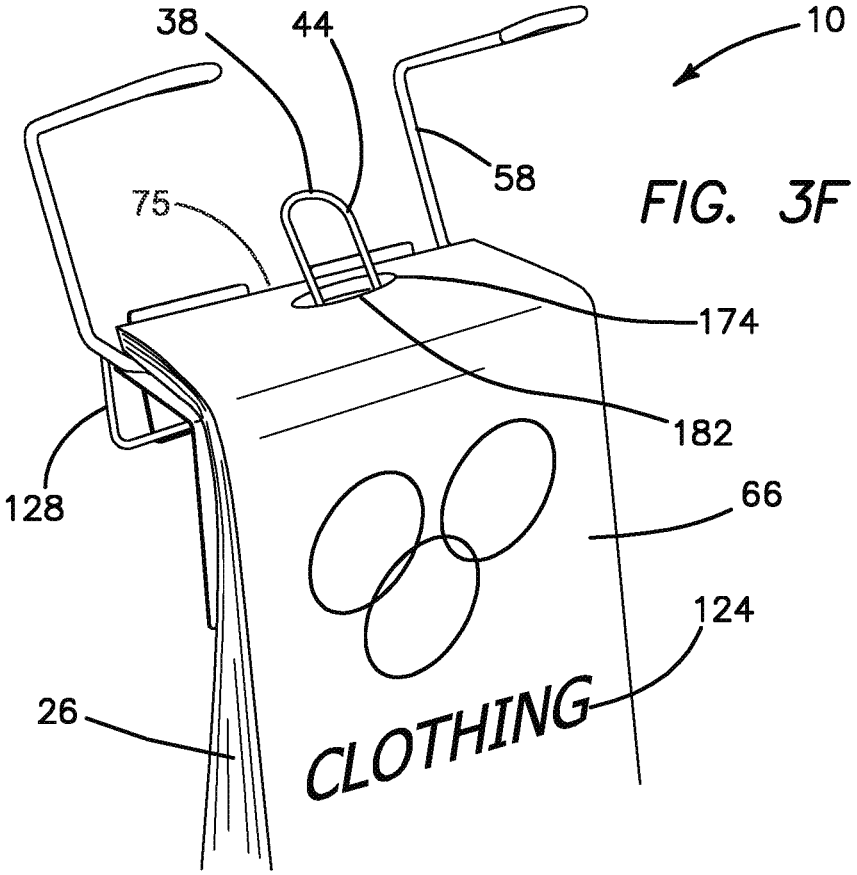
FIG. 3F is a partial perspective view of the FIG. 1 embodiment illustrating a dispenser loaded with oval handle bags using adhesive ink for a self-opening feature.

(7) In still a further variant, as illustrated in FIGS. 1D, 1E and 3E first 60 and second 64 horizontal control arms are provided. The control arms 60, 64 are attached either to or adjacent to the bag support platform 14 and are sized, shaped and located to align with hanging apertures 68, 72 located in handles 76, 78 of a T-shirt style bag 80.

Figure 7:
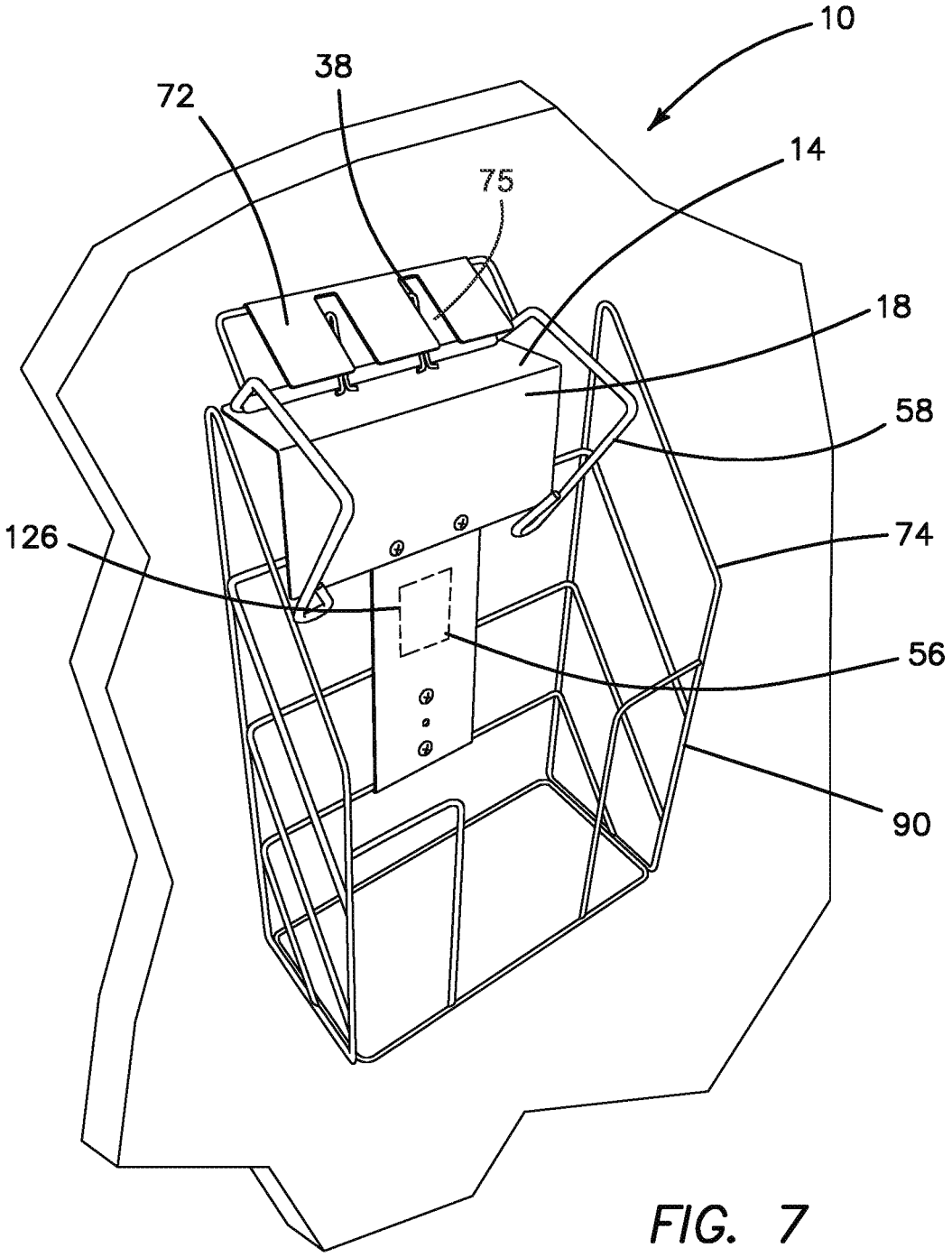
FIG. 7 is perspective view of the FIG. 1 embodiment illustrating a wall mounting positioning system with a looping and hooking attachment.
Figure 7A:
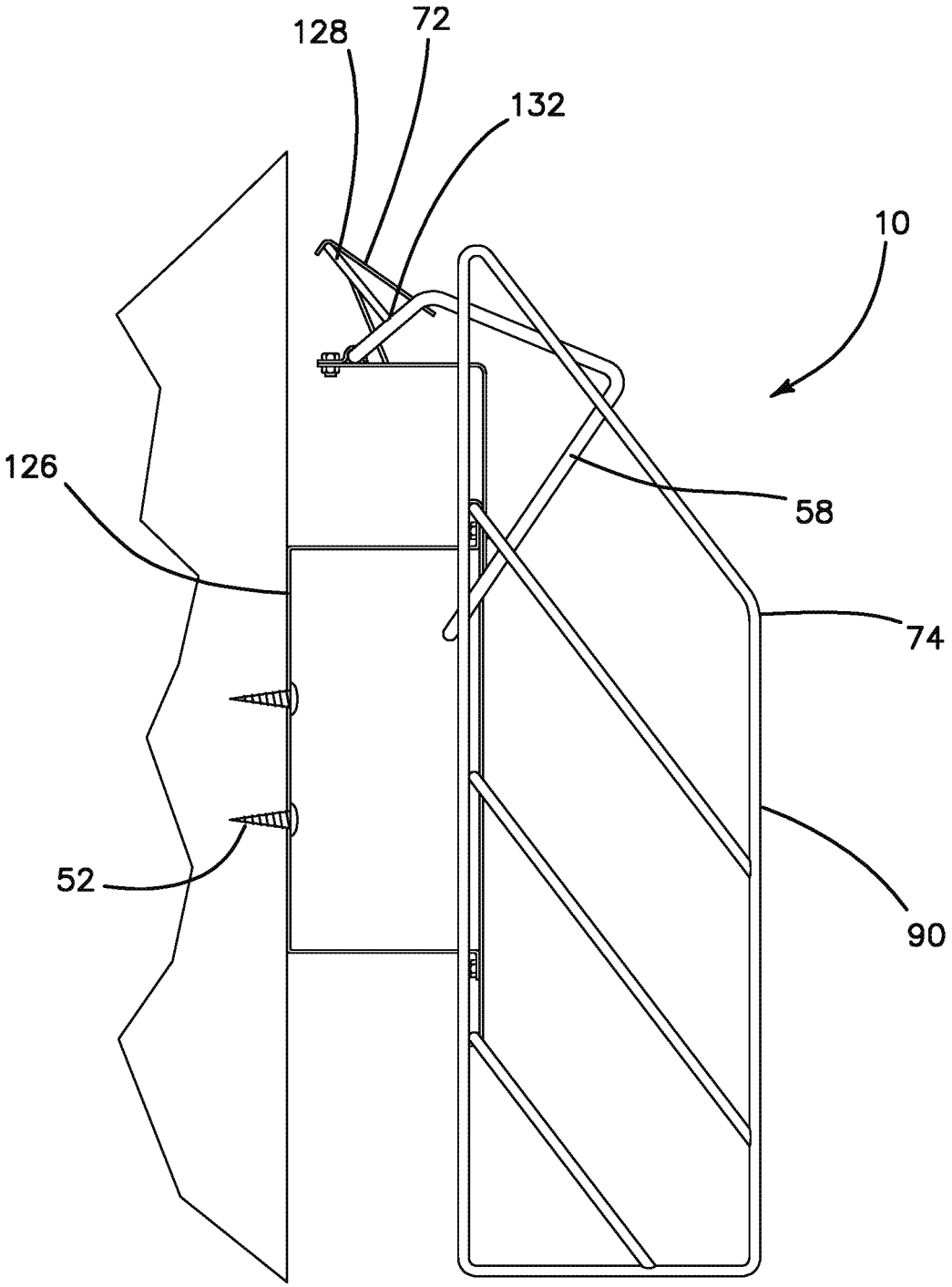
FIG. 7A is side elevational view of the FIG. 1 embodiment illustrating a wall mounting positioning system with a screw attachment.
Figure 8:
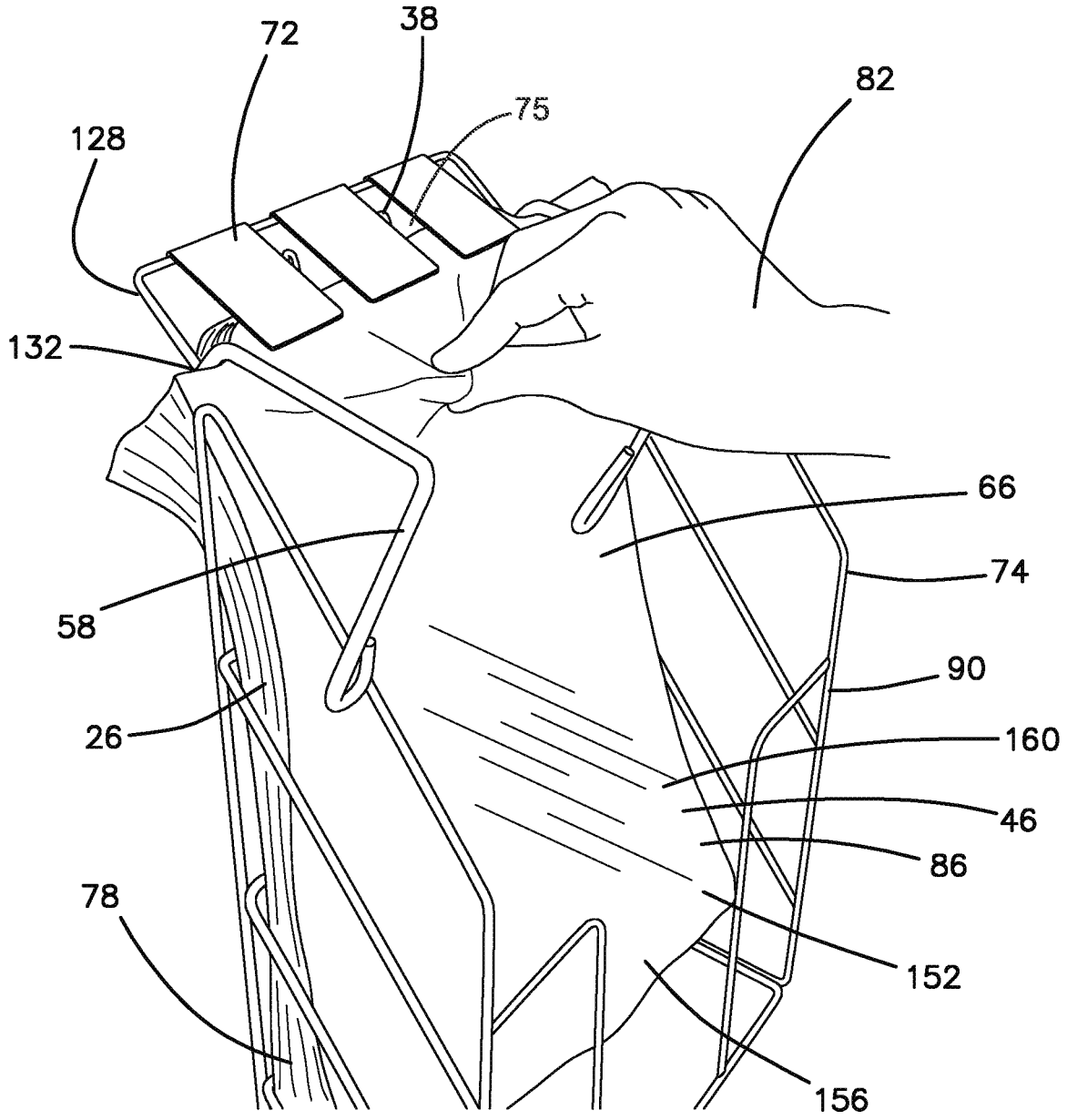
FIG. 8 is a partial perspective view of the FIG. 1 embodiment illustrating a user removing a bag from the dispenser.

(8) In a variant of the invention, as illustrated in FIGS. 1, 2, 7, 8 and 10, a surrounding control device 74 is provided. The device 74 is attached to either the bag support platform 14 or the positioning system 50. The surrounding control device 74 is sized shaped and located to surround at least a lower portion 78 of the bag pack 26, thereby preventing a user 82 from pulling a bag 46 from a lower portion 86 of the bag 46, as illustrated in FIG. 8.

(9) In another variant, the control device 74 is of wire form construction 90.

(10) In yet another variant, as illustrated in FIG. 1B, the control device 74 is formed of wood (not shown), plastic 76 or metal (not shown).

Figure 4:
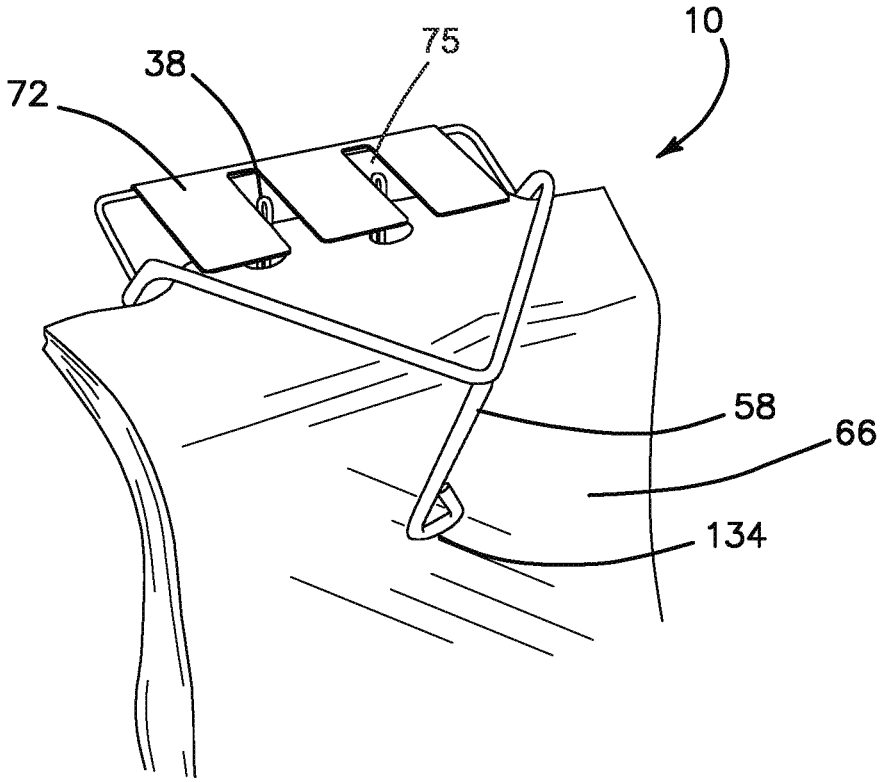
FIG. 4 is a partial perspective view of the FIG. 1A embodiment illustrating a dispenser with a single bag control arm contacting the outermost bag of the bag pack at a single point.
Figure 4A:
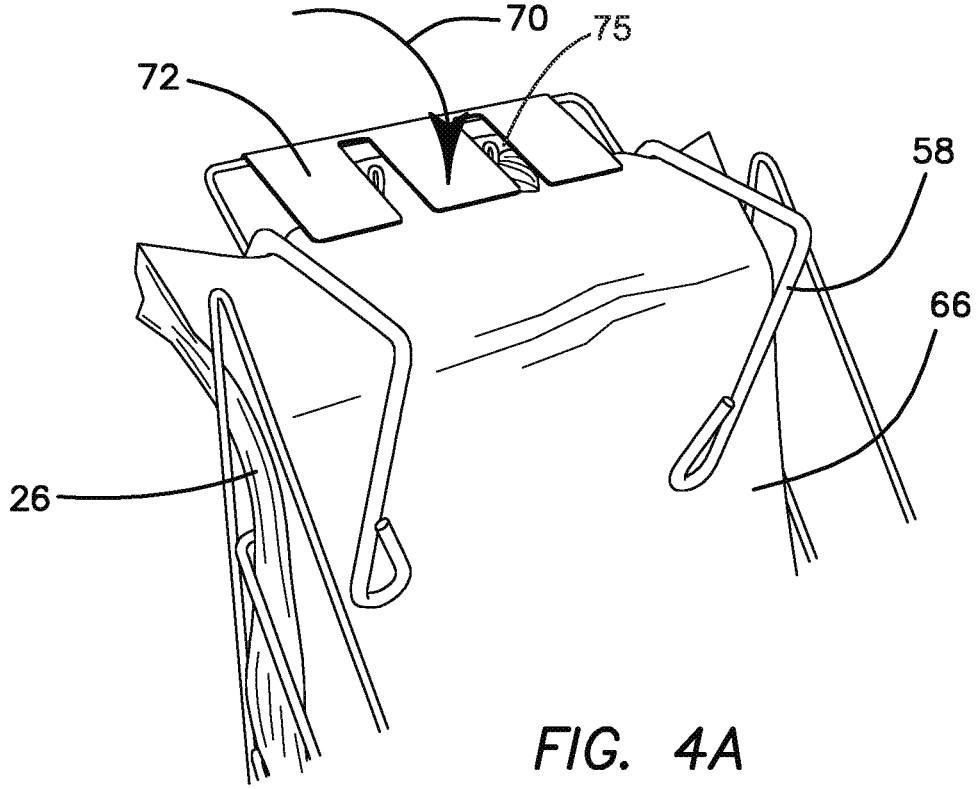
FIG. 4A is a partial perspective view of the FIG. 1 embodiment illustrating a the bag control arms in the control position.
Figure 4B:
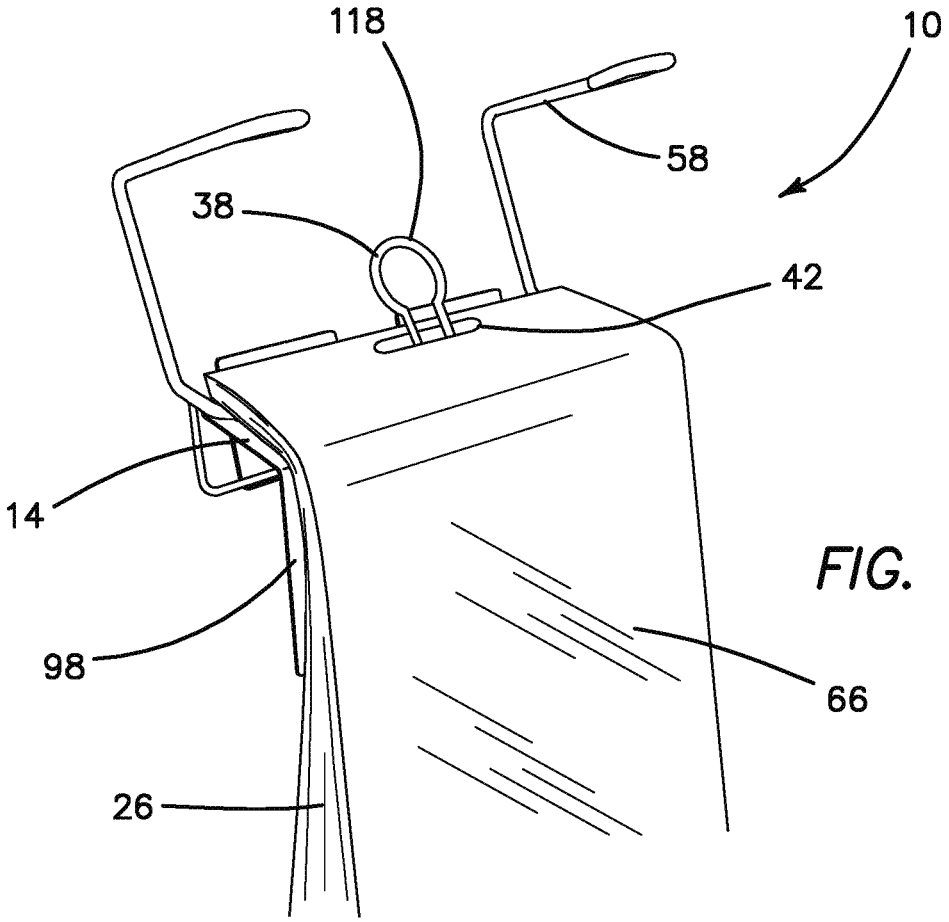
FIG. 4B is a partial perspective view of the FIG. 1A embodiment illustrating a slidably attached mounting hook attached to a horizontal bag support platform and the control arms in the loading position.

(11) In still another variant, as illustrated in FIGS. 3B and 4B, the support platform 14 has either of a vertical 94 and angled 98 planar surface.

Figure 4C:
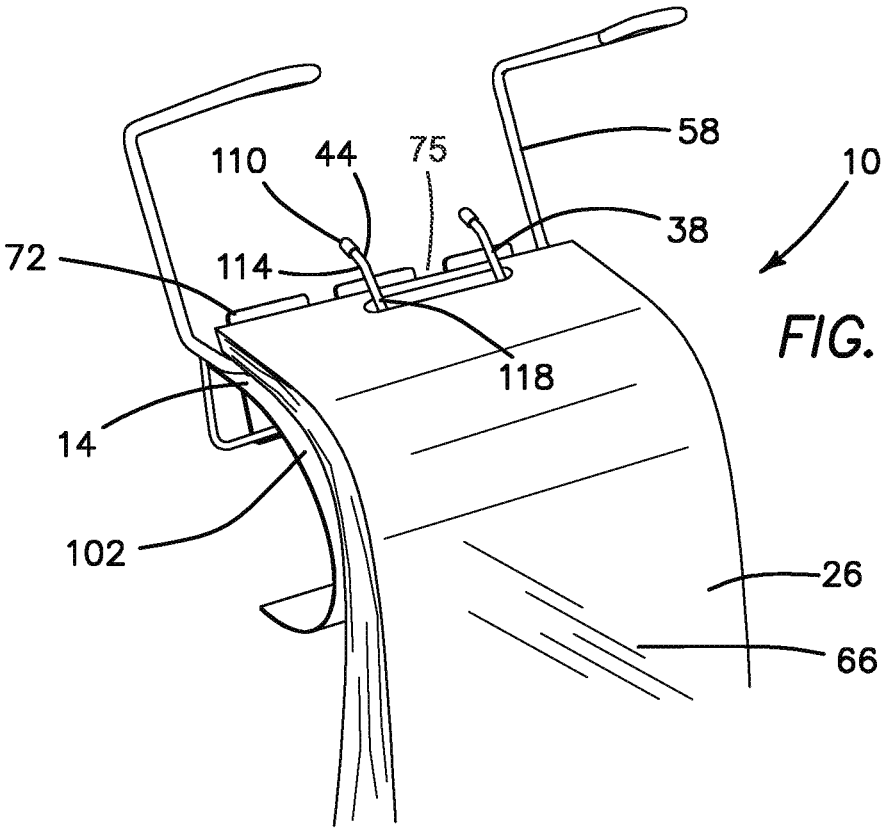
FIG. 4C is a partial perspective view of the FIG. 1 embodiment illustrating an angled hook mounting hook, cylindrical bag support platform and a race track handled bag.

(12) In a further variant, as illustrated in FIGS. 4C and 3D, the support platform 14 is horizontally oriented and has either a cylindrical 102 or convex 106 curved surface.

Figure 4E:
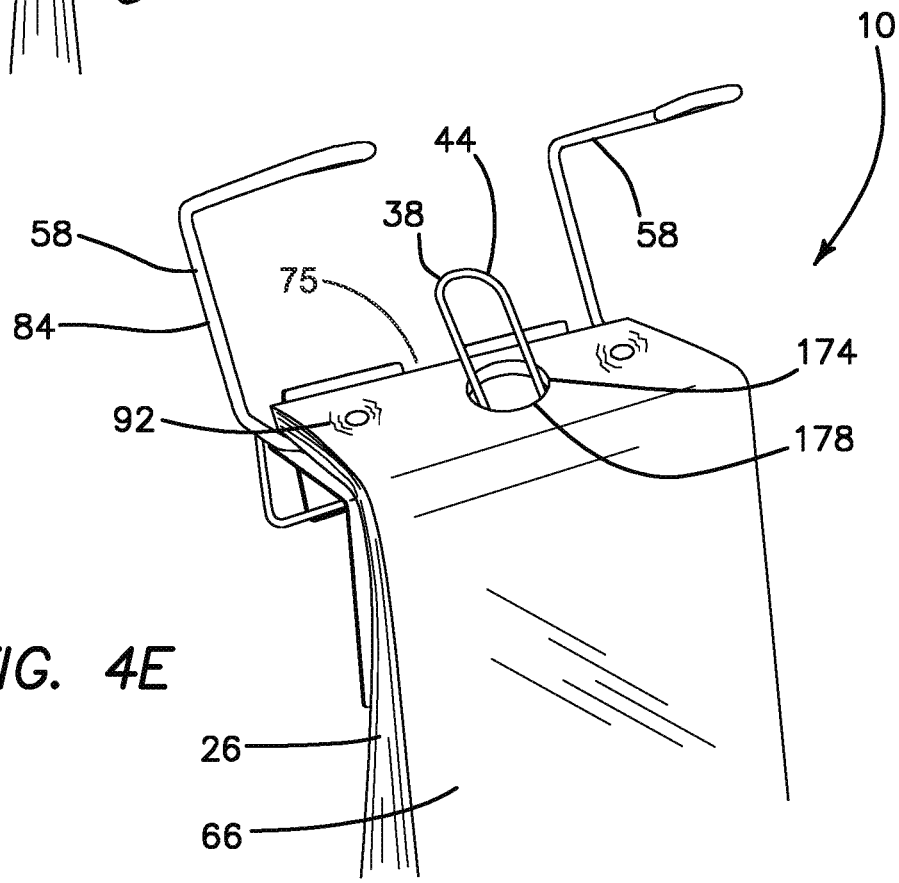
FIG. 4E is a partial perspective view of the FIG. 1 embodiment illustrating a dispenser loaded with round handle bags having a corona treatment and pressure adhesion means.
Figure 4F:
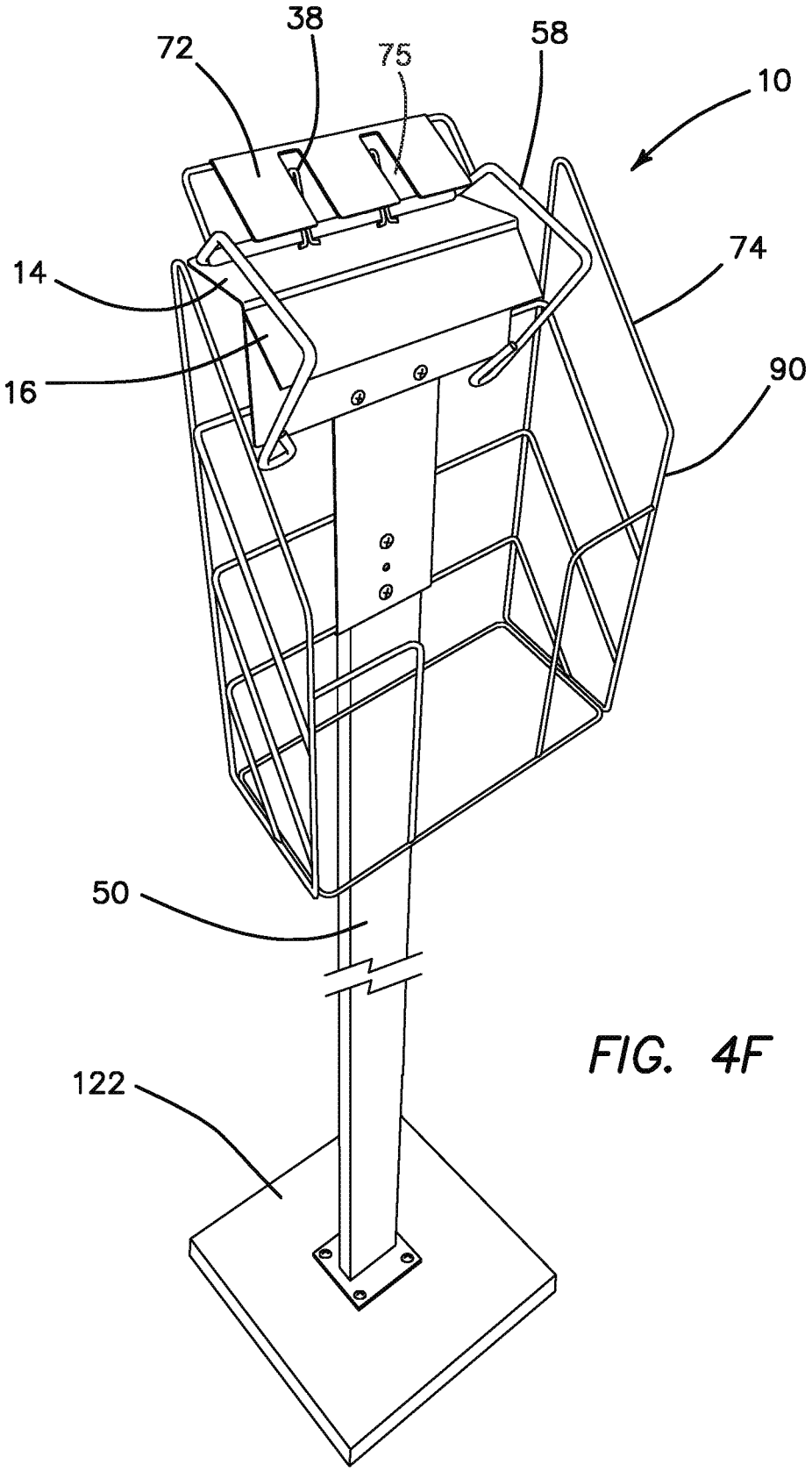
FIG. 4F is a partial perspective view of the FIG. 1 embodiment illustrating a dispenser with a canopy-style angled bag support platform.

(13) In still a further variant, as illustrated in FIG. 4F, the support platform 14 has a canopy-style angled bag support surface 16.

(14) In yet a further variant, as illustrated in FIG. 4C, the at least one mounting device 38 is a mounting hook 118 having an angled portion 114 adjacent a distal end 110 of the spike 118.

(15) In another variant of the invention, as illustrated in FIG. 3, the at least one mounting device 38 is slidably mounted to the bag support platform 14 and adapted to accommodate bags 46 having a variety of differently located mounting apertures 42.

(16) In still another variant, as illustrated in FIGS. 3B and 4B, the at least one mounting device 38 is a mounting hook 118.

(17) In yet another variant, as illustrated in FIG. 3B, the mounting hook 118 is slidably mounted to the bag support platform 14 and adapted to accommodate bags 46 having a variety of differently located mounting apertures 42.

(18) In a further variant, as illustrated in FIGS. 1C, 1F, 1G, and 111, the positioning system 50 is any of a floor stand 122, a counter mount 130 and a surface mount (not shown). The positioning system 50 is adapted to support at least two of the bag support platform 14.

(19) In still a further variant, as illustrated in FIG. 7, the positioning system 50 is a wall mount 126. The wall mount 126 supports the bag support platform 14.

Figure 10:
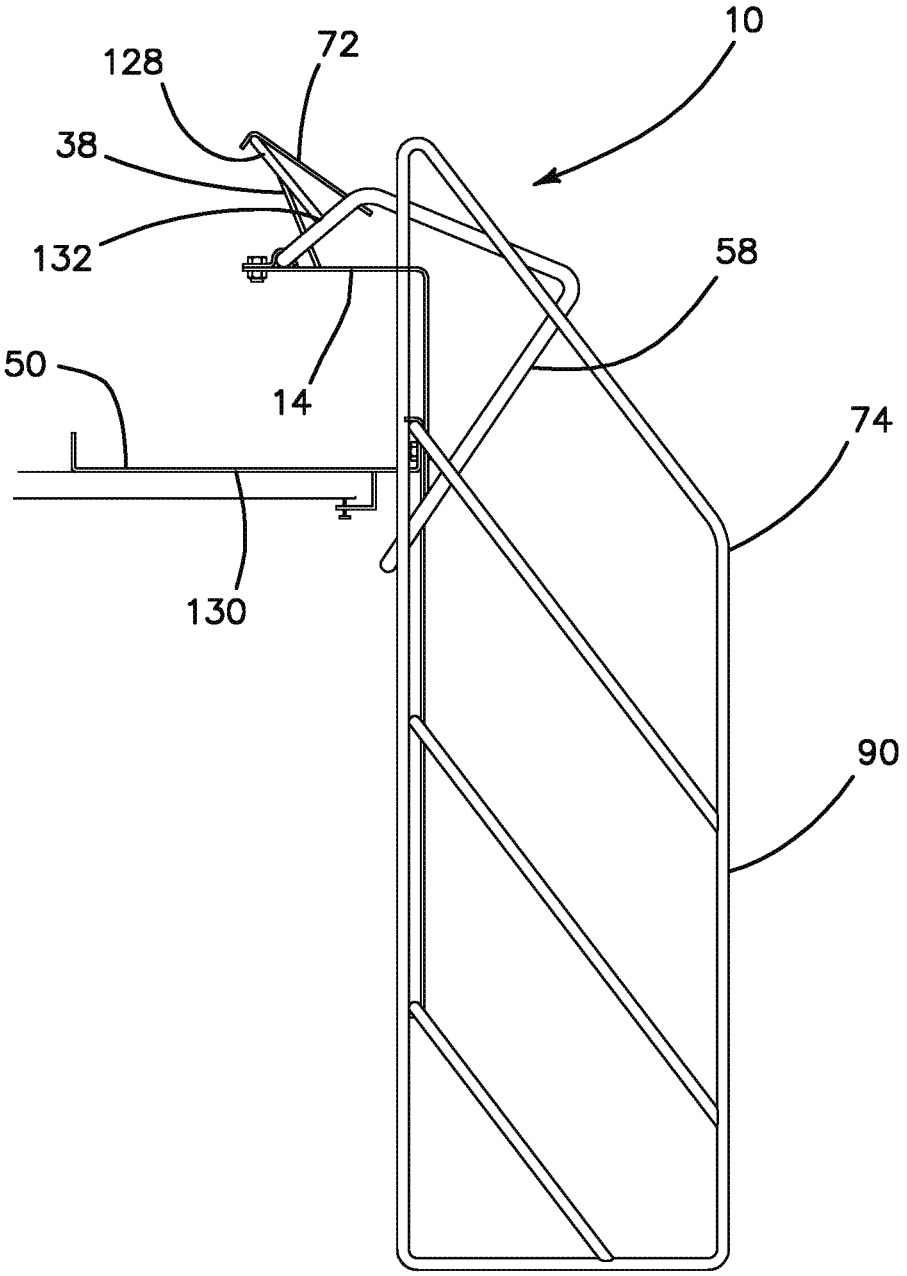
FIG. 10 is a side elevational view of the FIG. 1 embodiment illustrating a counter mounted positioning system.

(20) In yet a further variant, as illustrated in FIG. 10, the positioning system 50 is a counter mount 130. The counter mount 130 supports the bag support platform 14.

(21) In another variant of the invention, as illustrated in FIG. 4, the at least one pivotally mounted bag control arm 58 contacts the outermost bag 66 of the bag pack 26 at a single point 134.

Figure 5:
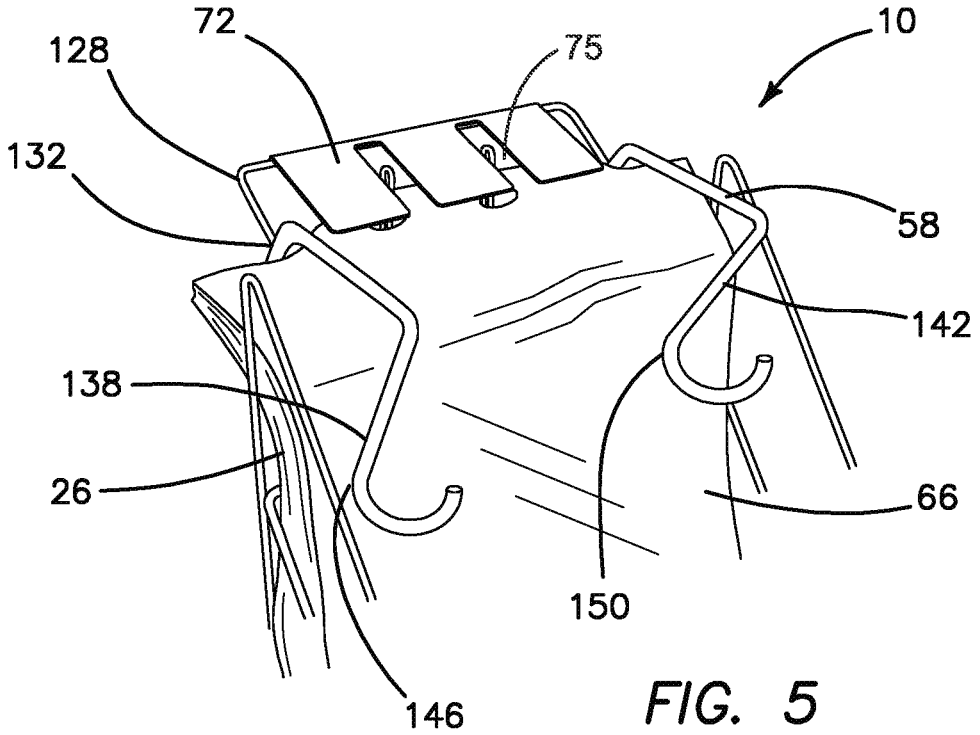
FIG. 5 is a partial perspective view of the FIG. 1 embodiment illustrating pivotally mounted bag control elements contacting the bag pack at two points.

(22) In still another variant, as illustrated in FIG. 5, the at least one pivotally mounted bag control arm 58 includes a pair of control arms 138, 142. The control arms 138, 142 contact the outermost bag 66 of the bag pack 26 at two points 146, 150.

Figure 6:
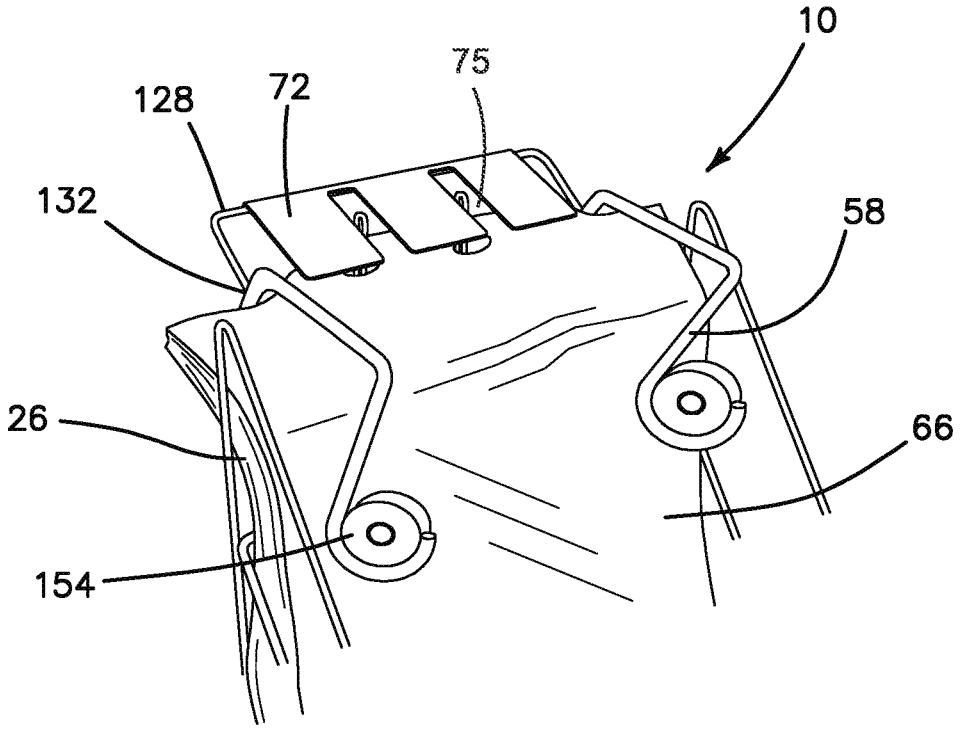
FIG. 6 is a partial perspective view of the FIG. 1 embodiment illustrating weights attached to the bag control elements.

(23) In a further variant, as illustrated in FIG. 6, the at least one pivotally mounted bag control arm 58 includes at least one weight 154. The weight 154 provides increased friction between the control arm 58 and the outermost bag 66.

Figure 9:
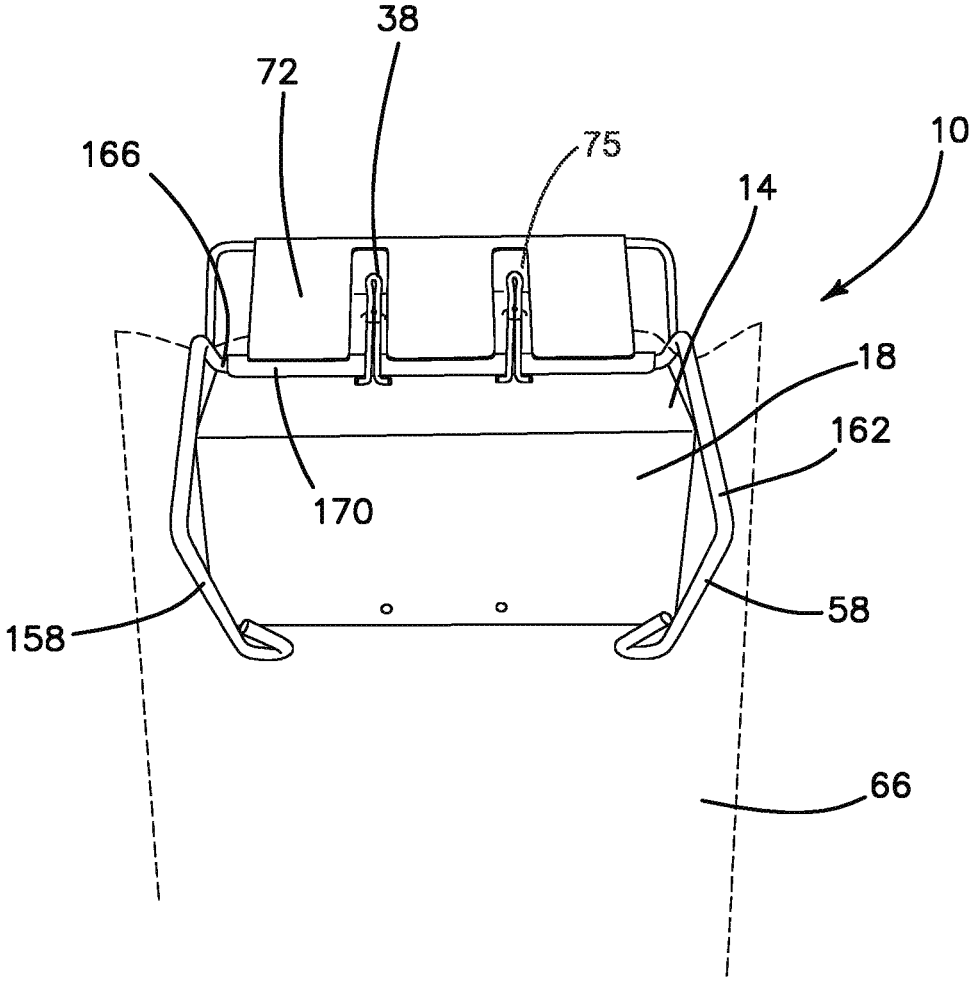
FIG. 9 is a partial perspective view of the FIG. 1 embodiment illustrating the pivotal mounting of the bag control elements.

(24) In still a further variant, as illustrated in FIGS. 1D, 1E and 9, the at least one pivotally mounted bag control arm 58 includes first 158 and second 162 bag control elements. The first 158 and second 162 elements are attached to a pivot rod 166. The pivot rod 166 is slidably located within a bearing structure 170. The bearing structure 170 is attached to the bag support platform 14.

(25) In yet a further variant, as illustrated in FIGS. 3D, 3F, 4C, 4D and 4E, the bag further includes a central handle 174. The central handle 174 is selected from the group that includes round 178, oval 182, kidney-shaped 186 and race-track (elongated round) 190.

(26) In another variant of the invention, as illustrated in FIG. 3E, the bag 80 further includes a top seam 24, a bottom seam 28, a U-shaped cut-out 32 commencing at the top seam 24, extending downwardly toward the bottom seam 28, proceeding across the bag 80 and rejoining the top seam 24, a central hanging aperture 36, the top seam 24 and bag material 108 adjacent the U-shaped cut-out 32 forming first 76 and second 78 bag handles, the bag handles 76, 78 have first 68 and second 72 hanging apertures located in an upper portion 112 of the handles 76, 78.

(27) In still another variant, the bag 80 further includes at least one side gusset 48.

(28) In yet another variant, as illustrated in FIGS. 3D, 3F, 4D and 4E, the bag pack 26 further includes self-opening bags 120. The self-opening bags 120 employ technology selected form the group comprising: corona treatment 88, corona treatment with pressure 92, knife cutting 96, adhesives 100, hot staking (not shown), cold pinning (not shown), special material formulations (not shown) and adhering inks 124.

(29) In a further variant, the special material formulation includes 40-48 wt. % high density, high molecular weight polyethylene, 12-20 wt. % high density, medium molecular weight polyethylene, 20-30 wt. % linear low density polyethylene, 0-8 wt. % color concentrate.

(30) In still a further variant, the special material formulation further includes 0.5 wt. % slip and antiblock compound.

(31) In yet a further variant, the special material formulation further includes 1-3 wt. % calcium carbonate.

(32) In another variant of the invention, the special material formulation further includes 10-20 wt. % recycled material, the recycled material comprising about 40-48 wt. % high density, high molecular weight polyethylene, 12-20 wt. % high density, medium molecular weight polyethylene, 20-30 wt. % linear low density polyethylene, 0-8 wt. % color concentrate.

(33) In still another variant, 10-15 wt. % of the linear low density polyethylene has a density ranging from 0.923-0.924 gm/cc.

(34) In yet another variant, 10-15 wt. % of the linear low density polyethylene has a melt index ranging from 0.25-0.30 gm/10 minutes.

(35) In a further variant, the high density, medium molecular weight polyethylene has a density ranging from 0.937-0.947 gm/cc.

(36) In still a further variant of the invention, the high density, medium molecular weight polyethylene has a melt index ranging from 0.10-0.30 gm/10 minutes.

(37) In yet a further variant, as illustrated in FIGS. 1D and 1E, a central mounting hook 118 and first 60 and second 64 horizontal control arms are provided. The mounting hook 118 and the control arms 60, 64 are attached either to or adjacent to one of the at least two of the bag support platforms 14.

The mounting hook 118 and the first 60 and second 64 horizontal control arms are sized, shaped and located to align with hanging apertures, 68, 69 located in bag material 108 adjacent a U-shaped cut-out 32 and handles 76, 78 of a T-shirt style bag 80, respectively.

Figure 1F:
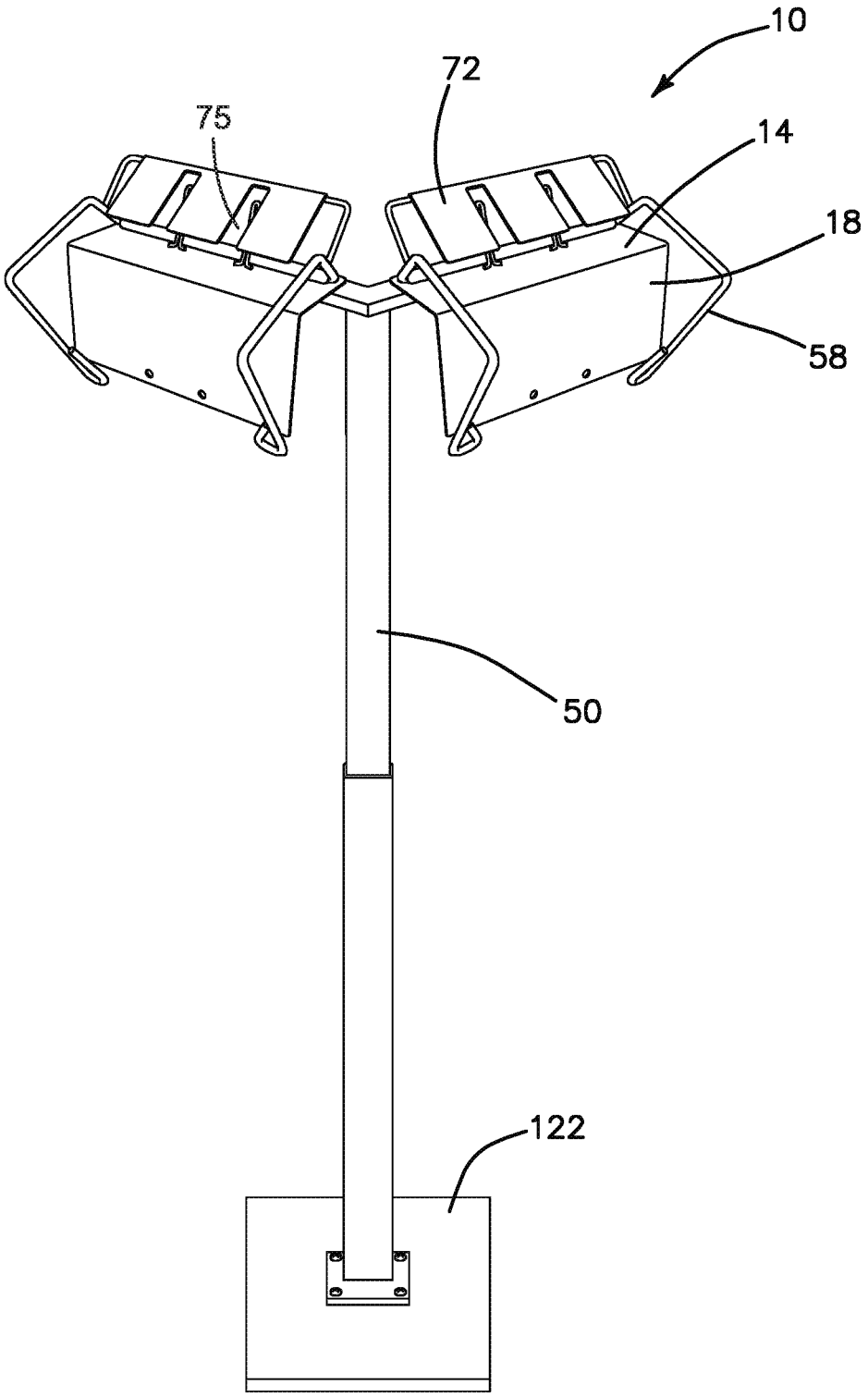
FIG. 1F is a perspective view of two of the FIG. 1A embodiment mounted at right angles to each other.
Figure 1G:
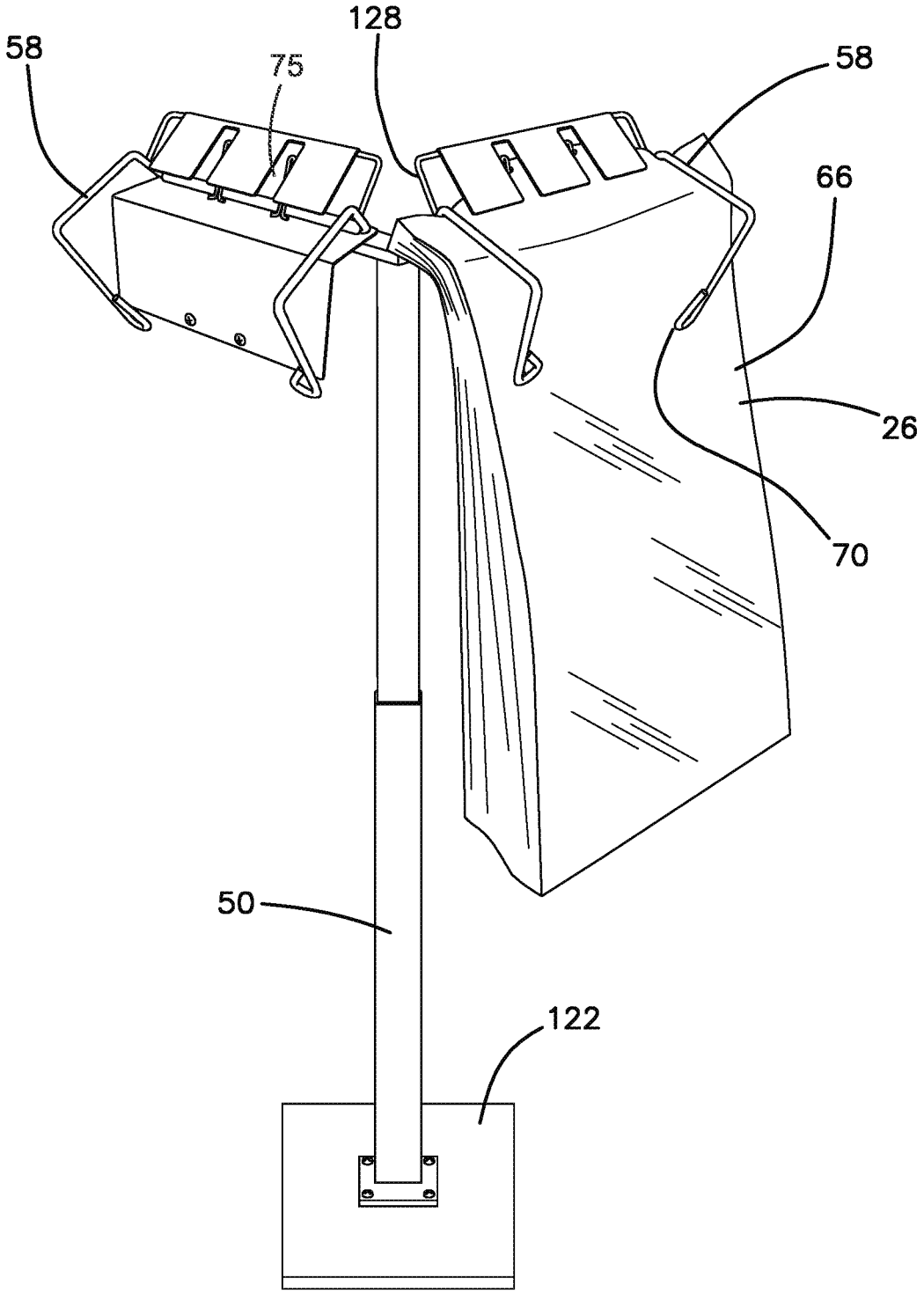
FIG. 1G is a perspective view of the FIG. 1F embodiment with a bag pack attached.
Figure 1H:
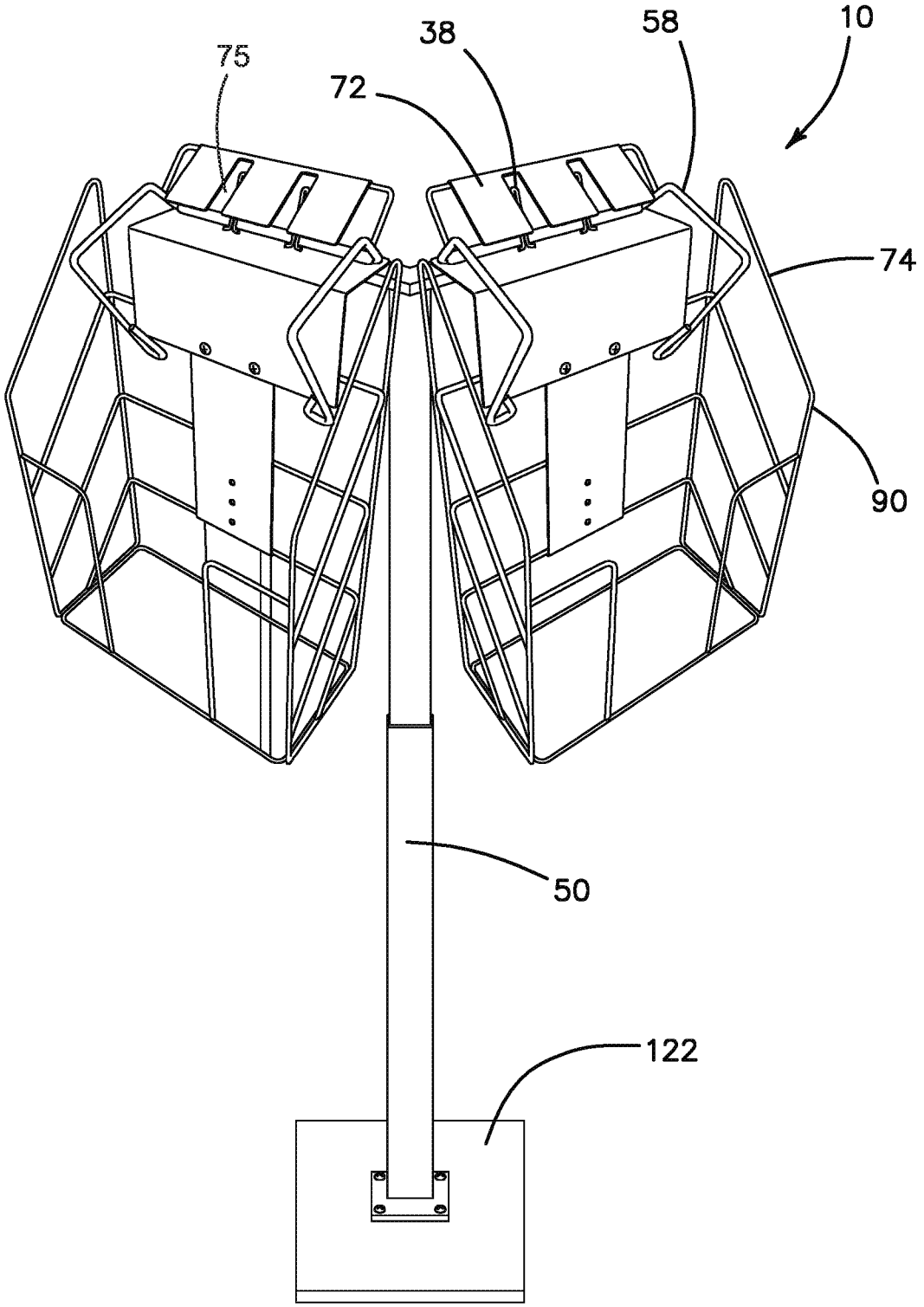
FIG. 1H is a perspective view of the FIG. 1F embodiment illustrating a removable surrounding control device.

(38) In another variant of the invention, as illustrated in FIGS. 1F, 1G and 1H, the positioning system 50 supports two bag support platforms 14. The platforms 14 are located at right angles to each other.

(39) In still another variant, as illustrated in FIG. 7, the dispenser 10 includes at least one removable surrounding control device 74. The device 74 is attached to either the bag support platform 14 or the positioning system 50. The device 74 is sized shaped and located to surround at least a lower portion 78 of the bag pack 26, thereby preventing a user 82 from pulling a bag 46 from a lower portion 86 of the bag 46.

(40) In yet another variant, as illustrated in FIGS. 1, 1A and 1B, the at least one guard plate 72 includes a first guard plate 80, located between a first pivotally mounted bag control arm 84 and a first mounting device 88, a second guard plate 92, located between the first mounting device 88 and a second mounting device 96, and a third guard plate 100 mounted between the second mounting device 96 and a second pivotally mounted bag control arm 104.

(41) In another variant, as illustrated in FIG. 3E, the at least one guard plate 72 includes a first side guard plate 180, disposed between a first pivotally mounted bag control arm 84 and a central mounting device 184 and a second side guard plate 188, located between the central mounting device 184 a second pivotally mounted bag control arm 104.

(42) In still another variant, as illustrated in FIGS. 1, 1A, 1B, 2D and 2E, the at least one guard plate 72 is attached to a mounting loop 128. The mounting loop 128 is attached at a first end 132 to the first pivotally mounted bag control arm 84 and attached at a second end 136 to the second pivotally mounted bag control arm 104.

(43) In yet another variant, the bag support platform 14 includes a horizontal portion 140 and a vertical portion 144. The at least one mounting device 38 is located upon the horizontal portion 140 and the at least one pivotally mounted bag control arm 58 is located to constrain the bag pack 26 between the bag control arm 58 and the vertical portion 144.

Figure 2:
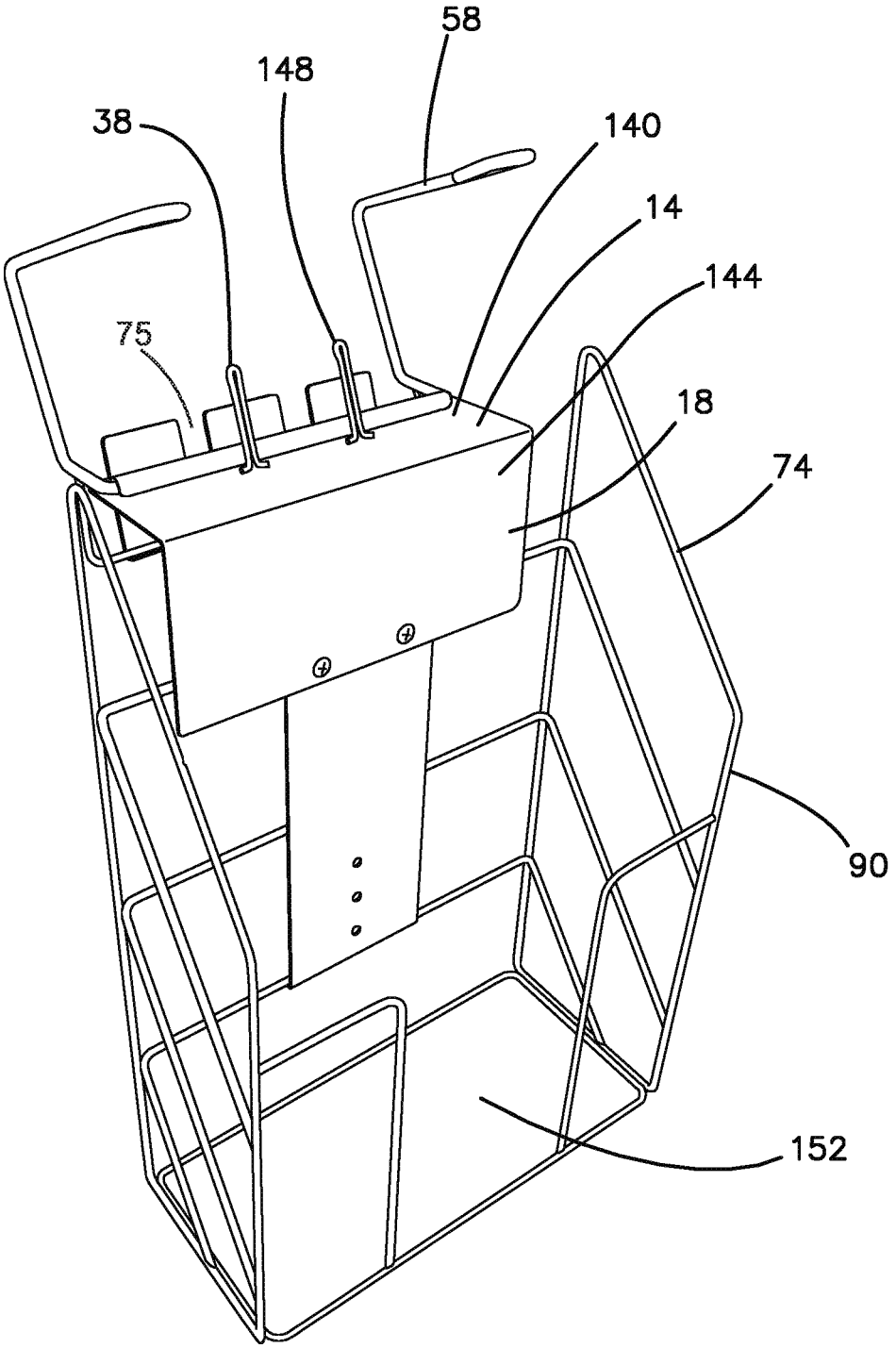
FIG. 2 is a perspective view of the FIG. 1 embodiment with the control arms in the loading position.

(44) In a further variant, as illustrated in FIG. 2, the at least one mounting device 38 includes at least one folded metal pin 148. The folded metal pin 148 is angled backwardly and attached to the horizontal portion 140.

Figure 2A:
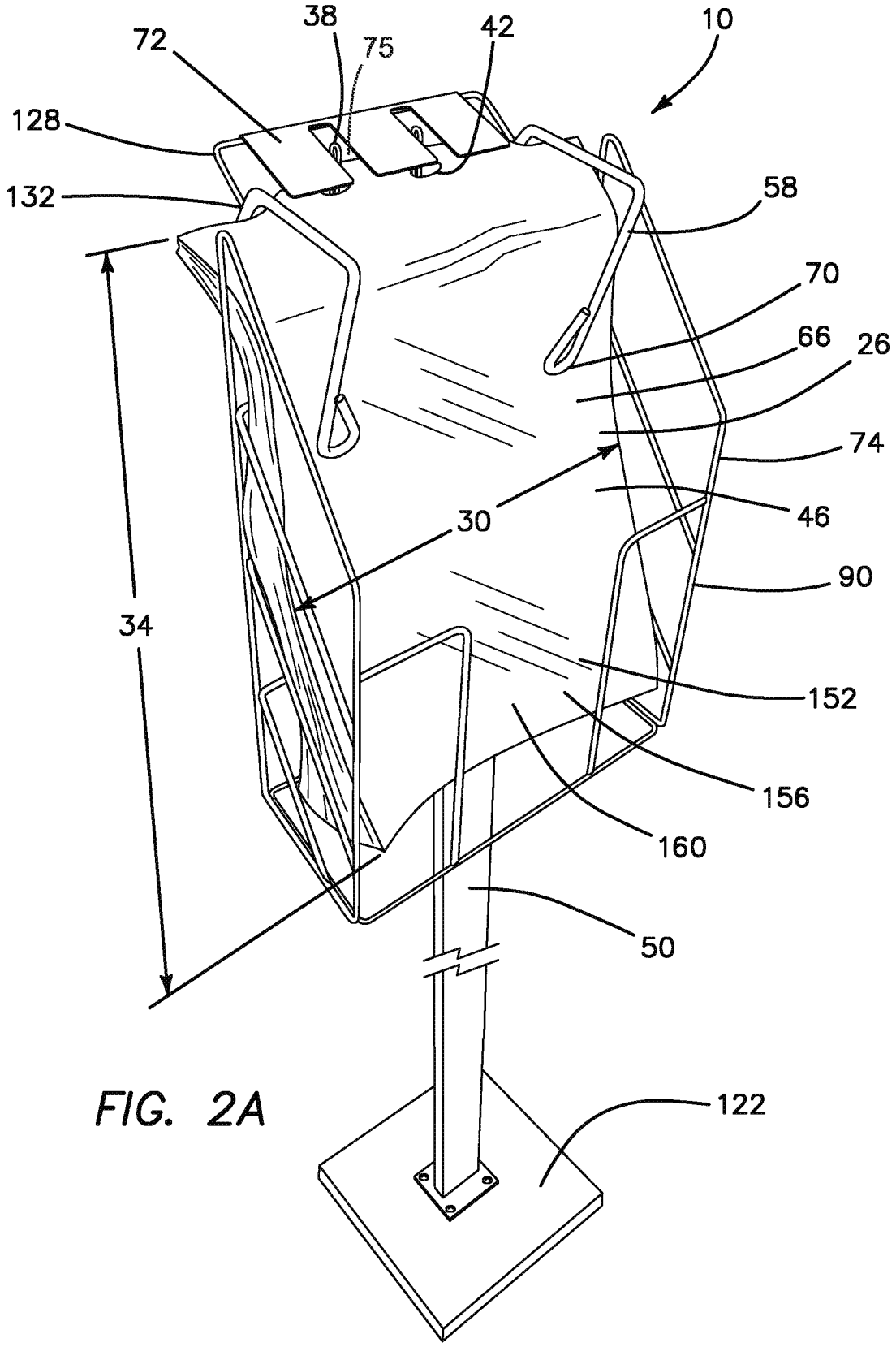
FIG. 2A is a perspective view of the FIG. 1 embodiment with a bag pack installed the control arms in the control position.
Figure 2B:
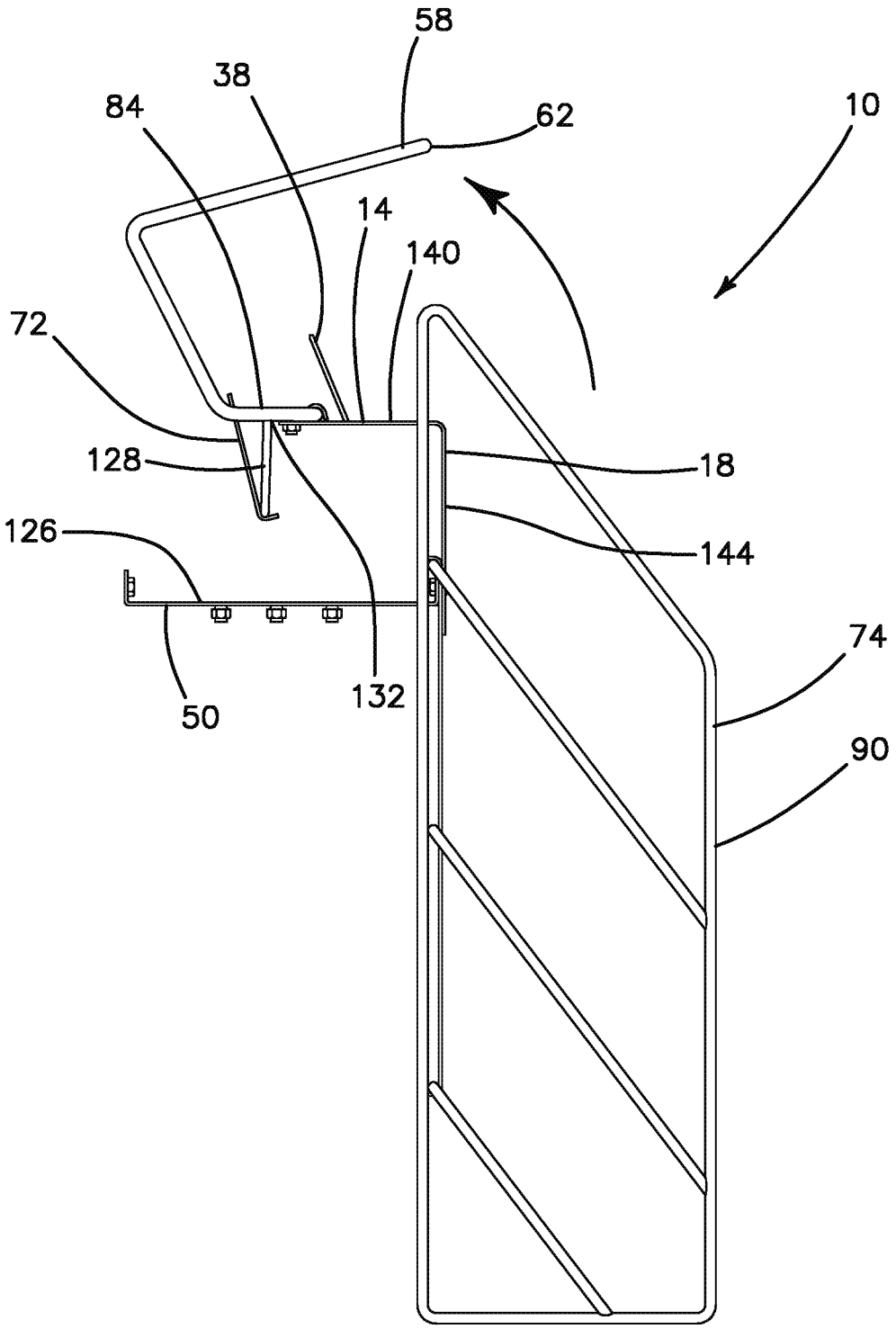
FIG. 2B is a side elevational view of a wall mount version of the FIG. 1 embodiment with the control arms in the loading position.
Figure 2C:
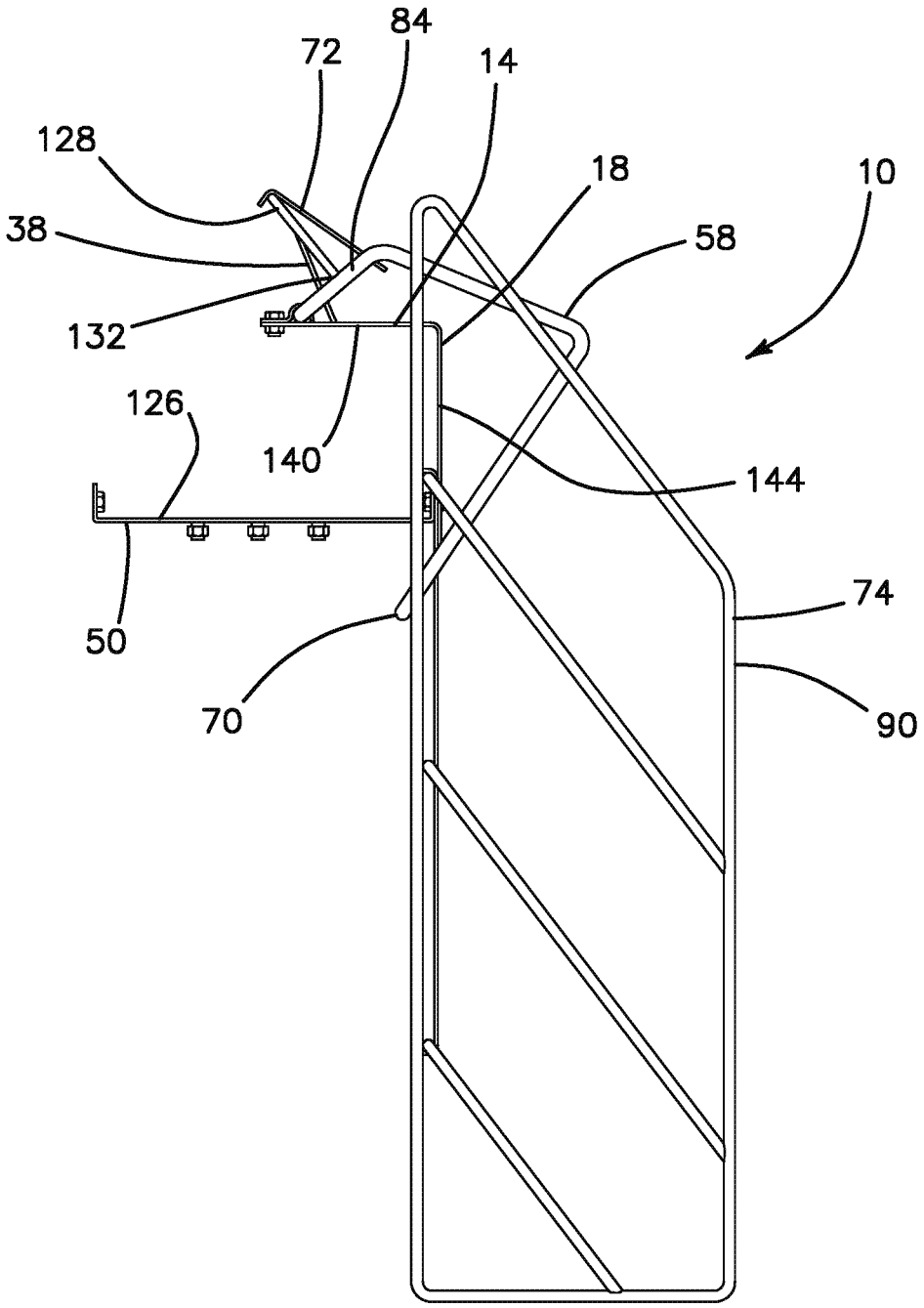
FIG. 2C is a side elevational view of the wall mount version of the FIG. 1 embodiment with the control arms in the control position.
Figure 2D:
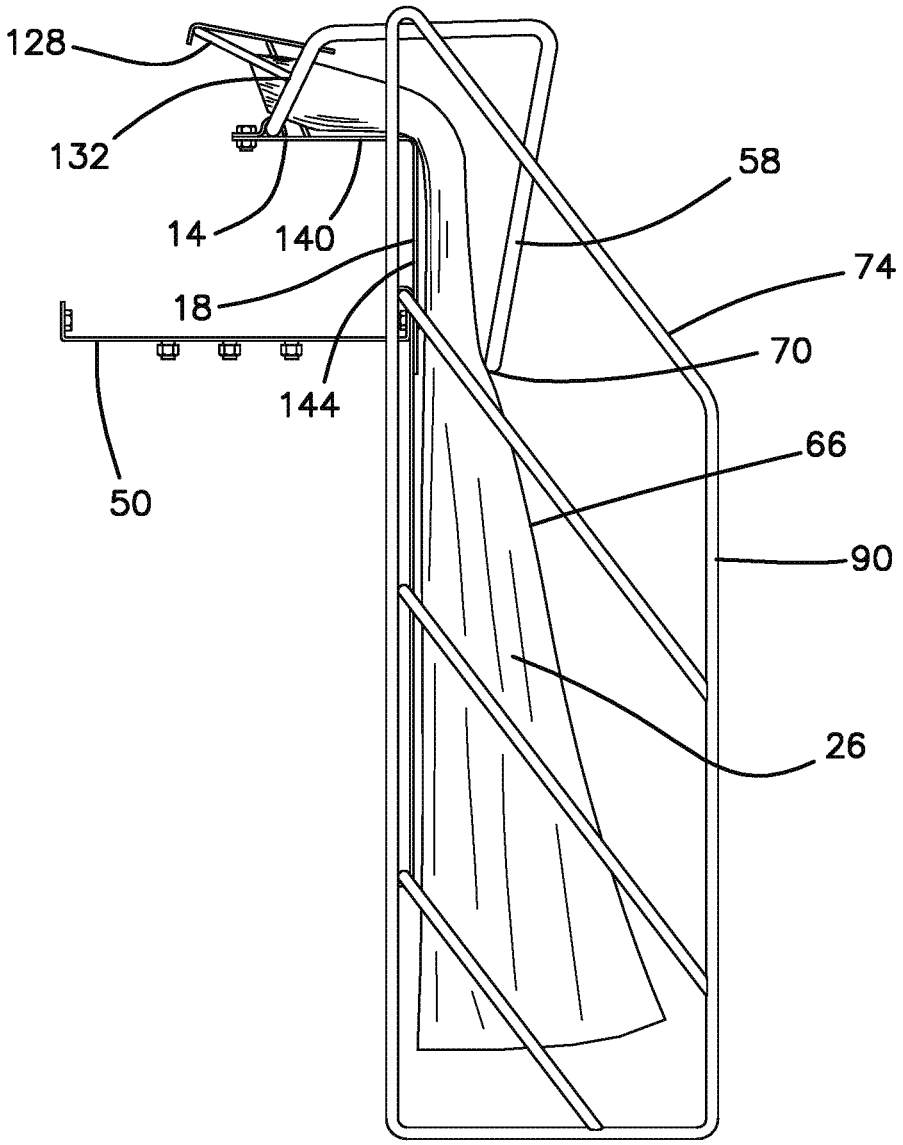
FIG. 2D is a side elevational view of the wall mount version of the FIG. 1 embodiment with a bag pack installed and with the control arms in the control position.

(45) In a still a further variant, as illustrated in FIGS. 2A and 7, the surrounding control device 74 includes a central opening 152. The central opening 152 permits access to a central portion 156 of a front surface 160 of the outermost bag 66.

Figure 2E:
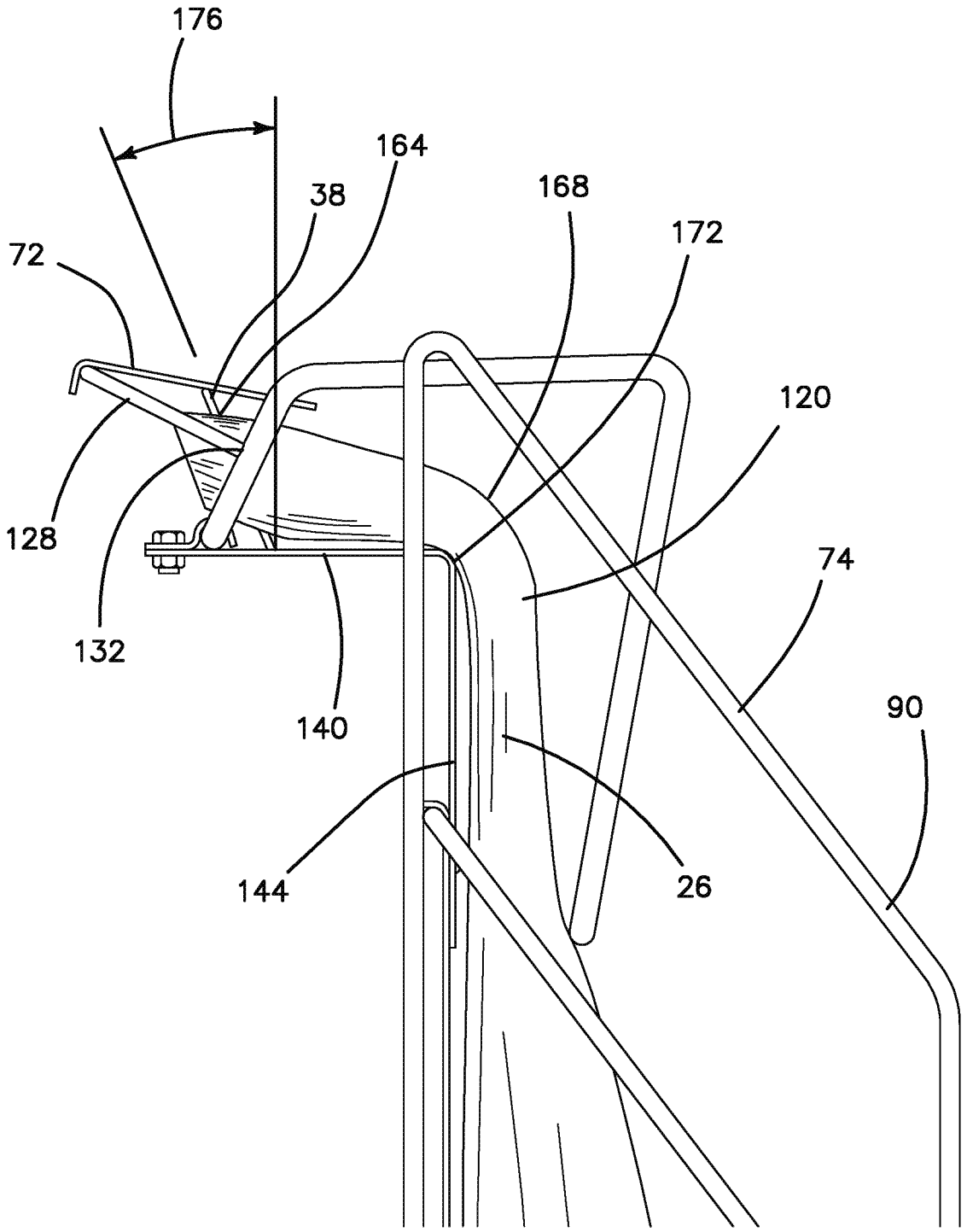
FIG. 2E is a close up partial side elevational view of the FIG. 2D embodiment illustrating the critical angle of the mounting device and related tension points.

(46) In yet a further variant, as illustrated in FIG. 2E, the at least one mounting device 38 is located upon the horizontal portion 140 at an angle 176 ranging from 20° to 50° to the vertical portion 144.

(47) In a final variant, the bag pack 26 mounted on the at least one mounting device 38 will have a first tension point 164 adjacent the at least one mounting device 38 and a second tension point 168 adjacent an intersection 172 of the horizontal portion 140 and the vertical portion 144. The first 164 and second 168 tension points will augment self-opening features 88, 92, 96, 100, 124 of bags 46 in the bag-pack 26.

The hanging bag dispenser 10 has been described with reference to particular embodiments. Other modifications and enhancements can be made without departing from the spirit and scope of the claims that follow.

The invention claimed is:

1. A hanging bag dispenser comprising:

a bag support platform, said platform providing a surface, said surface contacting a last bag in a vertically supported bag pack, said bag pack having a first predetermined width and a first predetermined length;

at least one mounting device, said device being attached to said bag support platform and being sized, shaped and disposed to engage a mounting aperture, said aperture penetrating each bag in said bag pack;

a positioning system, said system being attached to said bag support platform and maintaining said bag support platform at a height sufficient to allow said bag pack to extend downwardly for at least said first predetermined length;

at least one pivotally mounted bag control arm, said bag control arm being mounted to said bag support platform and being sized shaped and disposed to permit installation of said bag pack on said at least one mounting device when pivoted to a loading position and disposed to constrain an outermost bag in said bag pack when pivoted to a control position;

at least one guard plate, said at least one guard plate being mounted adjacent said at least one pivotally mounted bag control arm, said guard plate preventing access to an upper portion of bags in said bag pack when said pivotally mounted bag control arm is pivoted to said control position and said at least one guard plate having at least one access notch, said at least one access notch being disposed to provide clearance for said at least one mounting device, permitting viewing of said at least one mounting device and said bag pack to determine a number of bags remaining in said dispenser.

2. The hanging bag dispenser, as described in claim 1, wherein said at least one mounting device is upwardly and rearwardly angled.

3. The hanging bag dispenser, as described in claim 1, wherein said at least one mounting device comprises a bendable tab.

4. The hanging bag dispenser, as described in claim 1, wherein said at least one mounting device comprises an angled hook.

5. The hanging bag dispenser, as described in claim 1, wherein said at least one pivotally mounted bag control arm rests upon said outermost bag in said bag pack when pivoted to said control position.

6. The hanging bag dispenser, as described in claim 1, wherein said positioning system is selected from the group comprising:

floor stands, wall mounts, surface mounts, counter mounts, glue, screws, nails and looping and hooking fasteners (Velcro®).

7. The hanging bag dispenser, as described in claim 1, further comprising first and second horizontal control arms, said control arms being attached either of to and adjacent to said bag support platform and being sized, shaped and disposed to align with hanging apertures disposed in handles of a T-shirt style bag.

8. The hanging bag dispenser, as described in claim 1, further comprising a surrounding control device, said device being attached to either of said bag support platform and said positioning system, and being sized shaped and disposed to surround at least a lower portion of said bag pack, thereby preventing a user from pulling a bag from a lower portion of said bag.

9. The hanging bag dispenser, as described in claim 8 wherein said control device is of wire form construction.

10. The hanging bag dispenser, as described in claim 8 wherein said control device is formed of wood, plastic or metal.

11. The hanging bag dispenser, as described in claim 1, wherein said support platform comprises either of a vertical and angled planar surface.

12. The hanging bag dispenser, as described in claim 1, wherein said support platform is horizontally oriented and having either of a cylindrical and convex curved surface.

13. The hanging bag dispenser, as described in claim 1, wherein the support platform has a canopy-style angled bag surface.

14. The hanging bag dispenser, as described in claim 13, wherein at least one mounting device is a mounting spike having an angled portion adjacent a distal end of said spike.

15. The hanging bag dispenser, as described in claim 1, wherein said at least one mounting device is slidably mounted to said bag support platform and adapted to accommodate bags having a variety of differently located mounting apertures.

16. The hanging bag dispenser, as described in claim 1, wherein said at least one mounting device is a mounting hook.

17. The hanging bag dispenser, as described in claim 16, wherein said mounting hook is slidably mounted to said bag support platform and adapted to accommodate bags having a variety of differently located mounting apertures.

18. The hanging bag dispenser, as described in claim 1, wherein said positioning system further comprises any of a floor stand, a counter mount, and a surface mount, said positioning system adapted to support at least two of said bag support platform.

19. The hanging bag dispenser, as described in claim 1, wherein said positioning system is a wall mount, said wall mount supporting said bag support platform.

20. The hanging bag dispenser, as described in claim 1, wherein said positioning system is a counter mount, said counter mount supporting said bag support platform.

21. The hanging bag dispenser, as described in claim 1, wherein said at least one pivotally mounted bag control arm contacts said outermost bag of said bag pack at a single point.

22. The hanging bag dispenser, as described in claim 1, wherein said at least one pivotally mounted bag control arm comprises a pair of control arms, said control arms contacting said outermost bag of said bag pack at two points.

23. The hanging bag dispenser, as described in claim 1, wherein said at least one pivotally mounted bag control arm comprises at least one weight, said weight providing increased friction between said control arm and said outermost bag.

24. The hanging bag dispenser, as described in claim 1, wherein said at least one pivotally mounted bag control arm comprises first and second bag control elements; said first and second elements being attached to a pivot rod, said pivot rod being slidably disposed within a bearing structure, said bearing structure being attached to said bag support platform.

25. The hanging bag dispenser, as described in claim 1, wherein said bag further comprises a central handle, said central handle selected from the group comprising: round, oval, kidney-shaped and racetrack (elongated round).

26. The hanging bag dispenser, as described in claim 7, wherein said bag further comprises a top seam, a bottom seam, a U-shaped cut-out commencing at said top seam, extending downwardly toward said bottom seam, proceeding across said bag and rejoining said top seam, a central hanging aperture, said top seam and bag material adjacent said U-shaped cut-out forming first and second bag handles, said bag handles having first and second hanging apertures disposed in an upper portion of said handles.

27. The hanging bag dispenser, as described in claim 26, wherein said bag further comprises at least one side gusset.

28. He hanging bag dispenser, as described in claim 1, wherein said bag pack further comprises self-opening bags, said self-opening bags employing technology selected form the group comprising: corona treatment, corona treatment with pressure, knife cutting, adhesives, hot staking, cold pinning, special material formulations and adhering inks.

29. The hanging bag dispenser, as described in claim 28, wherein the special material formulation comprises 40-48 wt. % high density, high molecular weight polyethylene, 12-20 wt. % high density, medium molecular weight polyethylene, 20-30 wt. % linear low density polyethylene, 0-8 wt. % color concentrate.

30. The hanging bag dispenser, as described in claim 28, wherein the special material formulation further comprises 0.5 wt. % slip and antiblock compound.

31. The hanging bag dispenser, as described in claim 28, wherein the special material formulation further comprises 1-3 wt. % calcium carbonate.

32. The hanging bag dispenser, as described in claim 28, wherein the special material formulation further comprises 10-20 wt. % recycled material, said recycled material comprising about 40-48 wt. % high density, high molecular weight polyethylene, 12-20 wt. % high density, medium molecular weight polyethylene, 20-30 wt. % linear low density polyethylene, 0-8 wt. % color concentrate.

33. The hanging bag dispenser, as described in claim 28, wherein 10-15 wt. % of said linear low density polyethylene has a density ranging from 0.923-0.924 gm/cc.

34. The hanging bag dispenser, as described in claim 28, wherein 10-15 wt. % of said linear low density polyethylene has a melt index ranging from 0.25-0.30 gm/10 minutes.

35. The hanging bag dispenser, as described in claim 28, wherein said high density, medium molecular weight polyethylene has a density ranging from 0.937-0.947 gm/cc.

36. The hanging bag dispenser, as described in claim 28, wherein said high density, medium molecular weight polyethylene has a melt index ranging from 0.10-0.30 gm/10 minutes.

37. The hanging bag dispenser, as described in claim 18, further comprising a central mounting hook and first and second horizontal control arms, said mounting hook and said control arms being attached either of to and adjacent to one of said at least two of said bag support platform and being sized, shaped and disposed to align with hanging apertures disposed in bag material adjacent a U-shaped cut-out and handles of a T-shirt style bag, respectively.

38. The hanging bag dispenser, as described in claim 18, wherein said positioning system supports two bag support platforms, said platforms being disposed at right angles to each other.

39. The hanging bag dispenser, as described in claim 38, further comprising at least one removable surrounding control device, said device being attached to either of said bag support platform and said positioning system, and being sized shaped and disposed to surround at least a lower portion of said bag pack, thereby preventing a user from pulling a bag from a lower portion of said bag.

40. The hanging bag dispenser, as described in claim 1, wherein said at least one guard plate comprises a first guard plate, disposed between a first pivotally mounted bag control arm and a first mounting device, a second guard plate, disposed between said first mounting device and a second mounting device, and a third guard plate mounted between said second mounting device and a second pivotally mounted bag control arm.

41. The hanging bag dispenser, as described in claim 1, wherein said at least one guard plate comprises a first side guard plate, disposed between a first pivotally mounted bag control arm and a central mounting device and a second guard plate, disposed between said central mounting device and a second pivotally mounted bag control arm.

42. The hanging bag dispenser, as described in claim 40, wherein said at least one guard plate is attached to a mounting loop, said mounting loop being attached at a first end to said first pivotally mounted bag control arm and attached at a second end to said second pivotally mounted bag control arm.

43. The hanging bag dispenser, as described in claim 1, wherein said bag support platform comprises a horizontal portion and a vertical portion, said at least one mounting device being disposed upon said horizontal portion and said at least one pivotally mounted bag control arm being disposed to constrain said bag pack between said bag control arm and said vertical portion.

44. The hanging bag dispenser, as described in claim 43, wherein said at least one mounting device comprises at least one folded metal pin, said folded metal pin being angled backwardly and attached to said horizontal portion.

45. The hanging bag dispenser, as described in claim 8, wherein said surrounding control device includes a central opening, said central opening permitting access to a central portion of a front surface of said outermost bag.

46. The hanging bag dispenser, as described in claim 43, wherein said at least one mounting device is disposed upon said horizontal portion at an angle ranging from 30° to 45° to the horizontal.

47. The hanging bag dispenser, as described in claim 46, wherein said bag pack mounted on said at least one mounting device will have a first tension point adjacent said at least one mounting device and a second tension point at an intersection of said horizontal portion and said vertical portion, said first and second tension points augmenting self-opening features of bags in said bag-pack.

* * * * *